US006527367B2

(12) United States Patent
Yabe

(10) Patent No.: US 6,527,367 B2
(45) Date of Patent: Mar. 4, 2003

(54) INK JET RECORDING HEAD AND INK JET RECORDING APPARATUS

(75) Inventor: Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/944,140

(22) Filed: Sep. 4, 2001

(65) Prior Publication Data

US 2002/0041307 A1 Apr. 11, 2002

(30) Foreign Application Priority Data

Sep. 6, 2000 (JP) ..... 2000-270223

(51) Int. Cl.[7] ..... B41J 2/21
(52) U.S. Cl. ..... 347/43; 347/62; 347/65
(58) Field of Search ..... 347/43, 15, 40, 347/12, 65, 58, 62

(56) References Cited

U.S. PATENT DOCUMENTS

| | | | | |
|---|---|---|---|---|
| 4,723,129 A | | 2/1988 | Endo et al. | 347/56 |
| 4,740,796 A | | 4/1988 | Endo et al. | 347/56 |
| 5,175,565 A | | 12/1992 | Ishinaga et al. | 347/67 |
| 5,367,324 A | | 11/1994 | Abe et al. | 347/43 |
| 5,734,392 A | * | 3/1998 | Cornell | 347/17 |
| 6,109,719 A | | 8/2000 | Cornell | 347/14 |
| 6,286,924 B1 | * | 9/2001 | Ahne et al. | 347/10 |
| 6,309,052 B1 | * | 10/2001 | Prasad et al. | 347/57 |

FOREIGN PATENT DOCUMENTS

| | | |
|---|---|---|
| EP | 0 416 557 | 3/1991 |
| EP | 1 022 139 | 7/2000 |
| FR | 2 686 831 | 8/1993 |

* cited by examiner

*Primary Examiner*—Lamson Nguyen
(74) *Attorney, Agent, or Firm*—Fitzpatrick, Cella, Harper & Scinto

(57) ABSTRACT

An ink jet recording head comprises a plurality of pairs arranged correspondingly on one base plate, having at least a plurality of heat generating resistive elements for use of ink discharges arranged on the base plate for generating thermal energy for discharging ink as ink droplets; a plurality of ink discharge ports each arranged in a position facing each of the heat generating resistive elements; a plurality of ink flow paths each communicated with each of the ink discharge ports; and elongated ink supply ports arranged on the base plate along the lines of the heat generating elements for use of ink discharges, being communicated with the plurality of ink flow paths. Then, on the base plate of this ink jet recording head, at least each one of means for detecting the temperature of base plate to detect the temperature of the aforesaid base plate, and means for heating base plate to heat the aforesaid base plate are arranged, and the means for heating base plate is arranged on the base plate in the vicinity of the end portion of the ink supply ports in the longitudinal direction.

11 Claims, 16 Drawing Sheets

INK JET RECORDING HEAD AND INK JET RECORDING APPARATUS

BACKGROUND OF THE INVENTION

1. Field of the Invention

The present invention relates to an ink jet recording head and an ink jet recording apparatus provided with such recording head. More particularly, the invention relates to the structure of the element base plate (heater board) of an ink jet recording head.

2. Related Background Art

In recent years, many recording apparatuses have been used, and for these recording apparatuses, the higher recording speed, the higher resolution, the higher quality, and the lower amount of noises are demanded, among some others. Here, an ink jet recording apparatus can be cited as the recording apparatus that meets these demands.

For the typical structure and operational principle of the method used therefor, it is preferable to adopt those implemental by the application of the fundamental principle disclosed in the specifications of U.S. Pat. Nos. 4,723,129 and 4,740,796, for example. This method is applicable to the so-called on-demand type recording and a continuous type recording as well. Here, in particular, with the application of at least one driving signal that corresponds to recording information, the on-demand type provides an abrupt temperature rise beyond nuclear boiling by each of the heaters arranged corresponding to a sheet or a liquid path where ink is retained. Then, the heat generating resistive member is caused to generate thermal energy, hence creating film boiling on the thermal activation surface of a recording head to effectively form resultant bubbles in ink one to one corresponding to each driving signal. Then, by the growth and shrinkage of each bubble, liquid is discharged through each of the discharge openings, hence forming at least one droplet. The driving signal is more preferably in the form of pulses because the growth and shrinkage of each bubble can be made instantaneously and appropriately so as to attain the performance of excellent discharges of liquid, in particular, in terms of the response action thereof.

For the ink jet recording head of the kind, thermal energy is given to ink in each nozzle to create bubbles, and by means of bubbling power, ink is discharged for recording. Therefore, it is extremely important to provide the stabilization of ink discharges for the fulfillment of the aforesaid demands, and also, to control the temperature of the recording head in order to stabilize the discharging amount of ink.

To describe them more precisely, for the ink jet recording head that discharges ink by utilization of such energy as described above, the temperature of the base plate (hereinafter, may also be referred to as a heater board), where the heat generating resistive elements and the recording head wiring circuit are arranged, is influenced by the printing patterns at the time of actual printing and the environmental temperature as well. Also, depending on the temperature of the heater board at the time of driving, the time required for the application of driving signal until the actuation of bubbling is caused to be varied. As a result, the printing patterns in actual printing and the environmental temperature exert influence on the time required for the application of driving signal until the discharge is conditioned to perform an actual printing normally when the ink jet recording apparatus is driven for actual printing that begins with the status of being at rest, that is, the status of the so-called "initial discharge performance".

If the status of "initial discharge performance" is unfavorable, the influence that may be exerted on the actual printing becomes greater. As means for counteracting this condition, a method is adopted to perform preliminary ink discharges before printing by applying designated driving signals prior to the execution of the actual printing. However, this means requires the consumption of ink for the operation other than the actual printing.

Under the circumstances, a control method for controlling the temperature of the heater board within a designated range is taken as an effective measure in which temperature detecting means (diode sensor) is provided for detecting temperature on the heater board where the heaters are arranged for use of ink discharges, and the heaters for use of temperature control (sub-heaters), which are arranged in the vicinity of both end portions of the arrangement of heaters for use of ink discharges, and then, on the basis of the temperature detected by temperature detecting means, the heaters for use of temperature control are driven appropriately.

SUMMARY OF THE INVENTION

On the other hand, the performance required for the ink jet recording head at present should be such as to record in the image quality in precision higher still at recording speed faster still. Further, it is desired to make such head smaller still.

Now, therefore, in order to perform recording in an image quality higher still, it is required to discharge finer ink droplets under well-conditioned control. Also, in order to record at a recording speed faster still, it is required to increase the number of heaters for use of ink discharges. Then, for the attainment of the higher precision of recorded images at the faster recording speed, it is considered effective to adopt the structure of the so-called side shooter type where ink droplets are discharged in the direction perpendicular to the heater board which is the base plate having heat generating resistive elements for use of ink discharges formed therefor. For the recording head of side shooter type, the structure is adopted so that the ink supply into the head is made from the reverse side of each heat generating resistive element of the heater board by way of the through opening that penetrates the heater board. With the structure whereby to supply ink from the reverse side of the heater board, it becomes unnecessary to make the distance between the discharge ports and a recording medium larger owing to the presence of a member for supplying ink to the head. Consequently, the degradation of impact precision of discharged ink droplets can be prevented. Also, for the recording head of side shooter type, a plurality of discharge ports can be arranged on the plane with the advantages in forming a structure in which ink droplets of plural colors should be discharged.

However, any increased number of heaters on one heater board for the implementation of higher speed recording should present itself as a cause to make the heater board larger in size. Therefore, in order to make the size of the heater board as small as possible, there is a need for reducing the number of such elements as the aforesaid diode sensors and sub-heaters other than the regular heaters. Thus, the area occupied by them on the heater board should be made the smallest possible.

Here, therefore, with the purpose of attaining the provision of image quality in higher precision at higher speed of recording, and also, making the head smaller, the inventors hereof have simply attempted to reduce the number of diode sensors and sub-heaters for the recording head of the so-called side shooter type, where, as described above, heater lines for use of discharging ink of plural colors and ink discharge ports for use of plural colors are arranged on one heater board. Then, it is found that if the number of the diode sensors and sub-heaters is simply reduced, the "initial discharge performance" is degraded, and there occurs a problem that the color tone of recording images is not stabilized, among some others.

Under such circumstances, the inventors hereof have earnestly made a study to find the solution of such problems. As a result, it is ascertained that as compared with the recording head of the so-called edge shooter type where ink is discharge in the direction substantially horizontal to the heater board, these problems are encountered more conspicuously in the recording head of the side shooter mode. More precisely, it is found that in the mode of the side shooter recording head, a plurality of ink supply ports provided for the heater board demonstrate the heat insulating characteristic against the heater board material, and that this condition is the factor that should be taken into consideration when dealing with the problems described above. In other words, depending on the layout of the diode sensors and sub-heaters, the heat radiating action and the heat conduction of the heater board are deteriorated by the presence of the plural ink supply ports that shows the heat insulating characteristics. As a result, the diode sensors cannot detect the temperature of the heater board exactly or the transfer of heat generated by the sub-heaters becomes uneven on the heater board. This condition causes the initial discharge performance to be degraded or the color tone to be unstable due to the difference in temperature around each of discharge heaters used for the formation of each dot in plural colors.

As described above, there is a tendency that the discharge ports, the number of heaters arranged for one heater board, and the number of ink supply ports are increased to cope with the necessity of higher precision of recorded images at higher recording speed for an ink jet recording head. On the other hand, there is a need for making the heater board, having heater lines and ink supply ports arranged for use of plural colors, as small as possible in order to make a recording head itself lighter and smaller. Therefore, for a recording head of the so-called side shooter type where plural heater lines and ink supply ports are arranged on one heater board, it is necessary to prevent the "initial discharge performance" from being deteriorated and the color tone of recorded images from becoming unstable. To this end, there should be provided means for measuring the temperature of the heater board more efficiently in accordance with the temperature characteristics obtainable by temperature detecting means, as well as means for controlling the temperature of the heater board efficiently in accordance with such measurement information.

Now, therefore, the present invention aims at the provision of an ink jet recording head of the so-called side shooter type where heater lines and ink supply ports for use of plural colors are arranged for one heater board, which has attained the higher preciseness of the quality of recorded images at higher recording speed in a smaller size of the head itself, by arranging the layout of diode sensors and sub-heaters appropriately.

In order to achieve the object of the present invention described above, the ink jet recording head of the present invention comprises a plurality of pairs arranged correspondingly on one base plate, having at least a plurality of heat generating resistive elements for use of ink discharges arranged on the base plate for generating thermal energy for discharging ink as ink droplets; a plurality of ink discharge ports each arranged in a position facing each of the heat generating resistive elements; a plurality of ink flow paths each communicated with each of the ink discharge ports; and elongated ink supply ports arranged on the base plate along the lines of the heat generating elements for use of ink discharges, being communicated with the plurality of ink flow paths. Then, on the base plate of this ink jet recording head, at least each one of means for detecting the temperature of base plate to detect the temperature of the aforesaid base plate, and means for heating base plate to heat the aforesaid base plate are arranged, and the means for heating base plate is arranged on the base plate in the vicinity of the end portion of the ink supply ports in the longitudinal direction.

Further, for this ink jet recording head, it is conceivable to arrange a plurality of means for heating base plate on the base plate. In this case, it is preferable to make the number of means for heating base plate smaller than that of the ink supply ports.

Also, it is desirable to arrange on the base plate means for heating base plate in the vicinity of both end portions of the ink supply ports in the longitudinal direction symmetrically with respect to the ink supply port positioned in the center of the plurality of ink supply ports when the plural ink supply ports are arranged in parallel. Further, it is desirable to arrange means for heating base plate on the symmetrical line of the base plate. On the other hand, it is preferable to arrange means for detecting the temperature of base plate in the vicinity of end portions in the longitudinal direction on one side of the base plate.

Also, a plurality of ink supply ports may be arranged in parallel, and means for heating base plate may be arranged on one location in the vicinity of the end portion of the ink supply ports positioned in the center of the plurality of ink supply ports on one side in the longitudinal direction. In this case, it is preferable to arrange means for detecting the temperature of base plate in the vicinity of the end portion of the ink supply ports positioned in the center of the plurality of ink supply ports on the side opposite to the side having means for heating base plate arranged thereon.

Also, for the ink jet recording head described above, the one having, on one base plate, arranged at least plural lines of heat generating resistive elements corresponding to discharge ports for use of plural colors, driving circuits for driving each line of heat generating resistive elements for use of ink discharges, and electrode portions for connecting the driving circuits with the outside is preferably suitable, and for this one, each of elongated through openings serving as ink supply ports for use of each color ink being arranged on the area excluding at least each area of the base plate having the heat generating resistive elements for use of ink discharges, driving circuits, and electrode portions arranged, respectively.

Further, for the ink jet recording head described above, the one that uses energy generated by the heat generating resistive elements for use of ink discharges to create film boiling in ink to discharge ink droplets is preferably suitable.

Also, the ink jet recording apparatus of the present invention comprises an ink jet recording head having a plurality of pairs provided at least with a plurality of heat generating resistive elements for use of ink discharges arranged on the base plate for generating thermal energy for discharging ink as ink droplets; a plurality of ink discharge ports each arranged in a position facing each of the heat generating resistive elements; a plurality of ink flow paths each communicated with each of the ink discharge ports; and elongated ink supply ports arranged on the base plate along the lines of the heat generating elements for use of ink discharges, being communicated with the plurality of ink flow paths, and a plurality of the pairs being arranged in the direction substantially perpendicular to the arrangement direction of the heat generating resistive elements for use of ink discharges corresponding to one base plate, and on the base plate, at least each one of means for detecting the temperature of base plate to detect the temperature of the aforesaid base plate, and means for heating base plate to heat the aforesaid base plate being arranged, and means for heating base plate being arranged on the base plate in the vicinity of the end portion of the ink supply ports in the longitudinal direction; a carriage for mounting the ink jet recording head thereon; and carriage scanning means for the carriage to scan in the direction substantially in parallel to the arrangement direction of the aforesaid plural pairs.

With the side shooter type recording head structured as described above, it is compatible to form images in high precision and to attain a high printing speed. Conceivably, therefore, a plurality of ink supply ports are provided for one heater board. Then, for example, it becomes possible to implement the bidirectional printing without color unevenness by arranging plural ink supply ports for one and the same color ink in the head scanning direction.

With the structure having a plurality of elongated ink supply ports, it becomes possible to keep the temperature distribution on the base plate as uniform as possible in the arrangement direction of ink supply ports with the minimum sub-heater number without causing the heat transfer to be impeded by the presence of a plurality of ink supply ports and many numbers of heat generating resistive elements for use of ink discharges by arranging means for heating base plate (sub-heater) in the vicinity of end portion of the ink supply ports on the base plate in the longitudinal direction. In this way, the "initial discharge performance" can be kept in good condition, while making the temperature difference smaller on the circumference of each heat generating resistive element for use of ink discharges to form each of the recording dots for representation of plural colors, hence making it possible to record with stabilized color tones.

Also the layout of the sub-heater that can maintain the uniformity of the temperature distribution of the base plate makes it possible to reduce the arrangement number of the means for detecting the temperature of the base plate which is provided for the base plate to control the base pate temperature. Further, this layout enables the degree of freedom to be widened for the arrangement locations thereof. Thus, the size of the base plate can be made as small as possible even if the number of elements and wiring circuits are increased on the base plate along the intended attainment of higher preciseness of the quality of image formation.

As has been described, when designing a heater board, it is made possible to arrange elements more effectively so as to provide an ink jet recording head which is not only excellent in productivity at lower costs, but also, in the implementation of higher saving of power dissipation.

DETAILED DESCRIPTION OF THE PREFERRED EMBODIMENTS

Hereinafter, with reference to the accompanying drawings, the detailed description will be made of the embodiments in accordance with the present invention.

FIGS. 1A and 1B to FIG. 6 are views which illustrate the structures of a recording head cartridge, a recording head, and an ink tank, respectively, which embody the present invention or to which the present invention is applicable, as well as the respective relations between them.

Figure 1A:
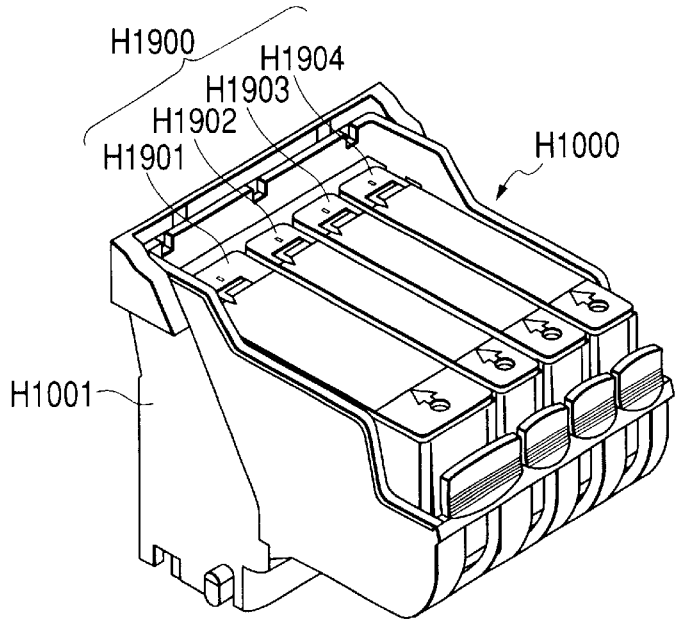
FIG. 1A is a perspective view which shows a recording head cartridge of an ink jet recording head embodying the present invention.
Figure 1B:
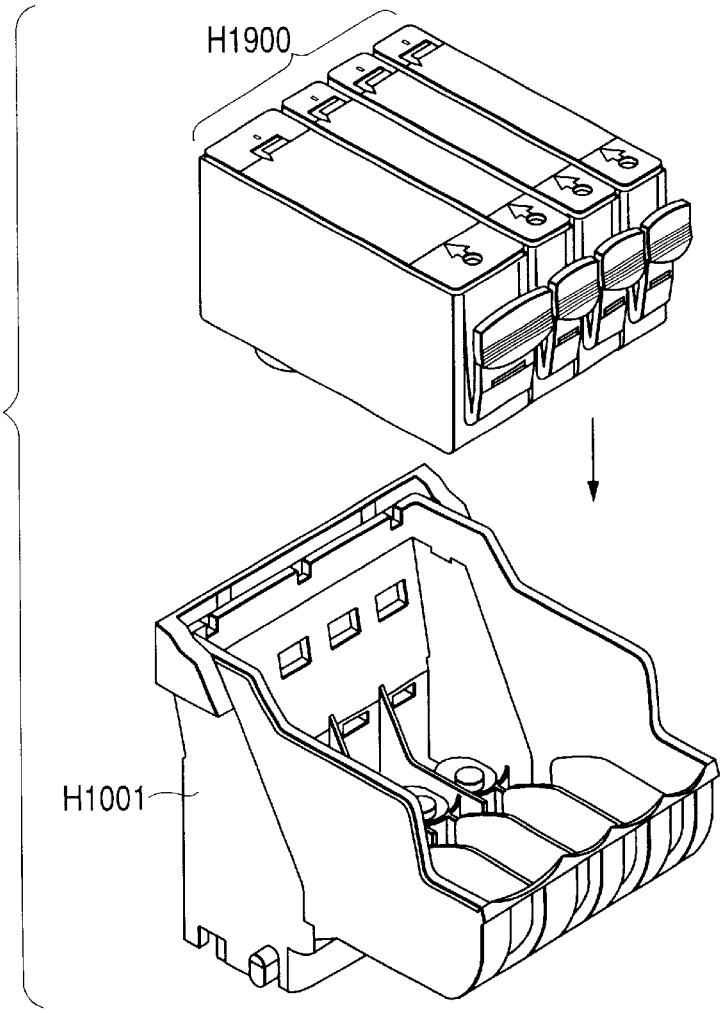
FIG. 1B is an exploded perspective view which shows the structure thereof.

The recording head of the present embodiment (ink jet recording head) H1001 is one constituent that forms the recording head cartridge H1000 as understandable from the representation of FIGS. 1A and 1B. Then, the recording head cartridge H1000 comprises a recording head H1001; ink tanks H1900 (H1901, H1902, H1903, and H1904) which are installed on the recording head H1001 freely attachable or detachable. The recording head H1001 discharges from the discharge ports the ink (recording liquid) which is supplied from each of the ink tanks H1900 in accordance with recording information.

The recording head cartridge H1000 is supported to be fixed on the main body of an ink jet recording apparatus by positioning means and electrical contacts of a carriage (not shown), while being detachably mountable on the carriage. The ink tank H1901 is for black ink use, the ink tank H1902 is for cyan ink use, the ink tank H1903 is for magenta ink use, and the ink tank H1904 is for yellow ink use. Then, in this way, the ink tanks H1901, H1902, H1903, and H1904 are freely detachable or attachable to the recording head H1001 on the sealing rubber H1800 side, respectively, and each of the tanks is made replaceable in order to reduce the running costs of printing by use of the ink jet recording apparatus.

Next, the detailed description will be made of the recording head H1001 per constituent that forms the recording head one after another.

1. Recording Head

The recording head H1001 is the one which is the side shooter type using the bubble jet method that records using electrothermal converting devices (recording elements) to generate thermal energy for creating film boiling in ink in accordance with electric signals.

Figure 2:
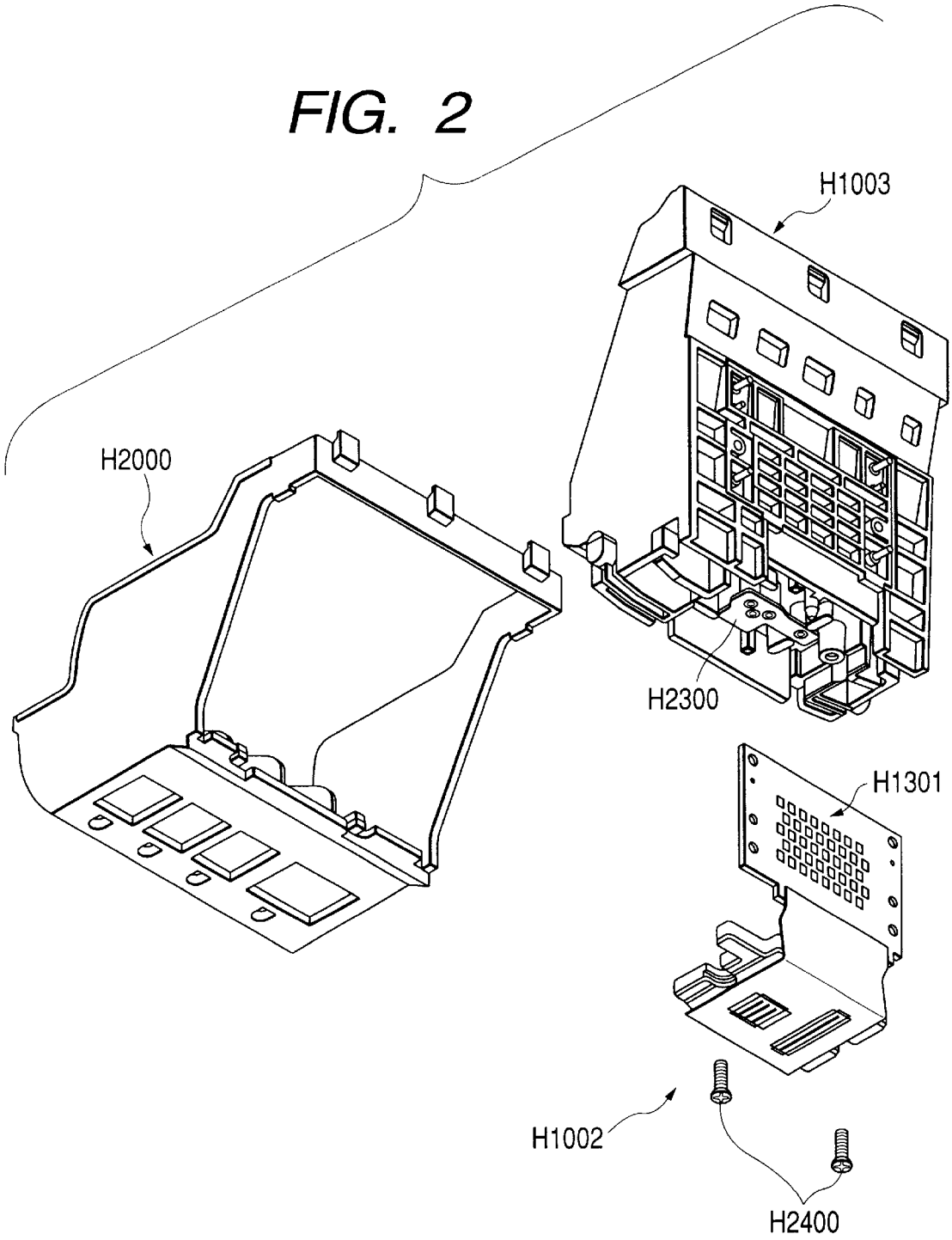
FIG. 2 is an exploded perspective view which shows the structure of the recording head represented in FIGS. 1A and B.

As shown in FIG. 2 which is an exploded perspective view, the recording head H1001 comprises a recording element unit H1002; an ink supply unit H1003; and a tank holder H2000.

Figure 3:
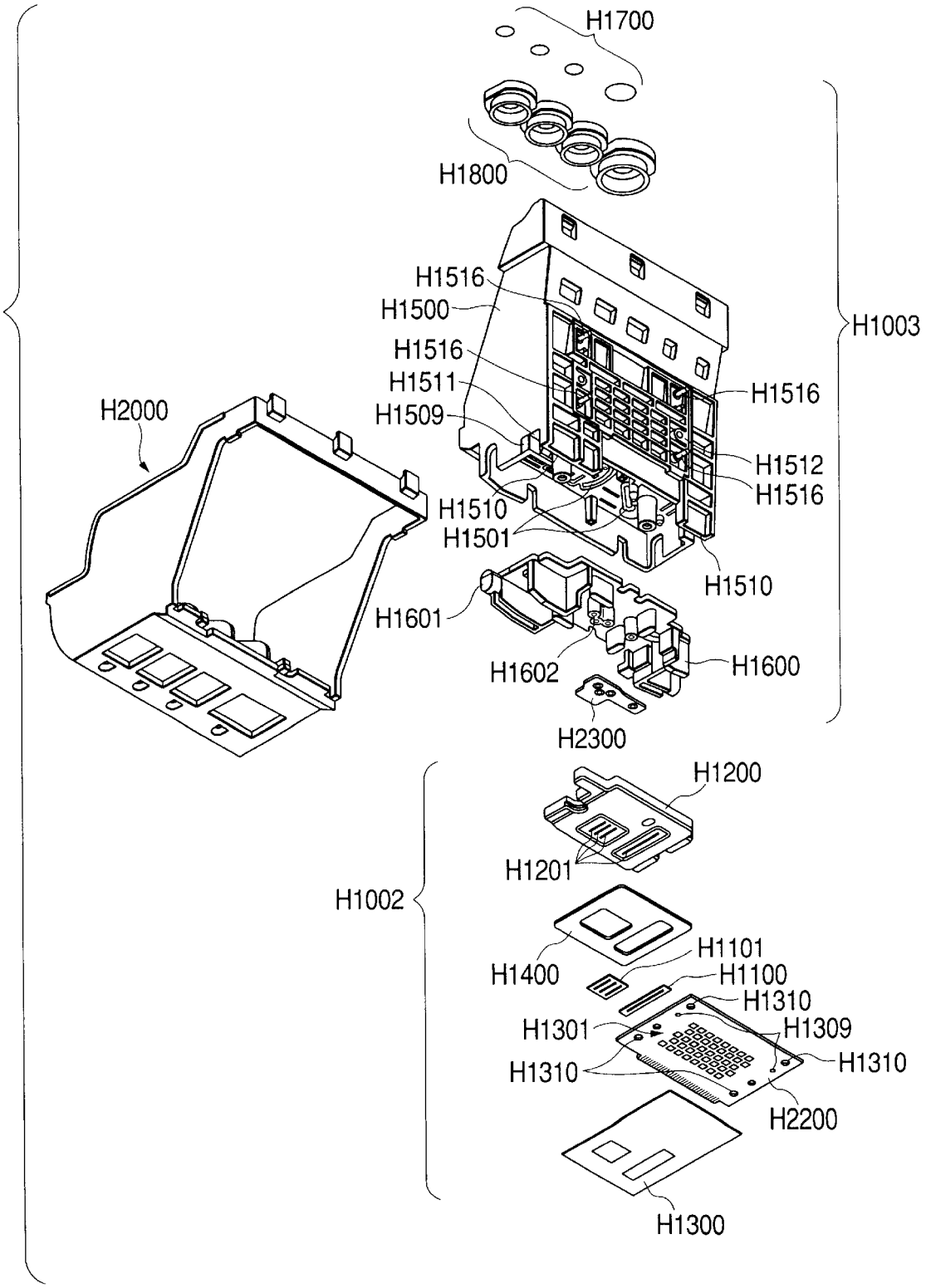
FIG. 3 is an exploded perspective view which shows the recording head represented in FIG. 2 further in detail in the disassembled form.

Further, as shown in FIG. 3 which is also an exploded perspective view, the recording element unit H1002 comprises a first recording element base plate H1100; a second recording element base plate 1101; a first plate (first supporting member) H1200; an electric wiring tape (flexible wiring base plate) H1300; an electric contact board H2200; and a second plate (second supporting member) H1400. Also, the ink supply unit H1003 comprises an ink supply member H1500; a flow path formation member H1600; a joint sealing member H2300; a filter H1700; and a sealing rubber H1800.

1-a. Recording Element Unit

Figure 4:
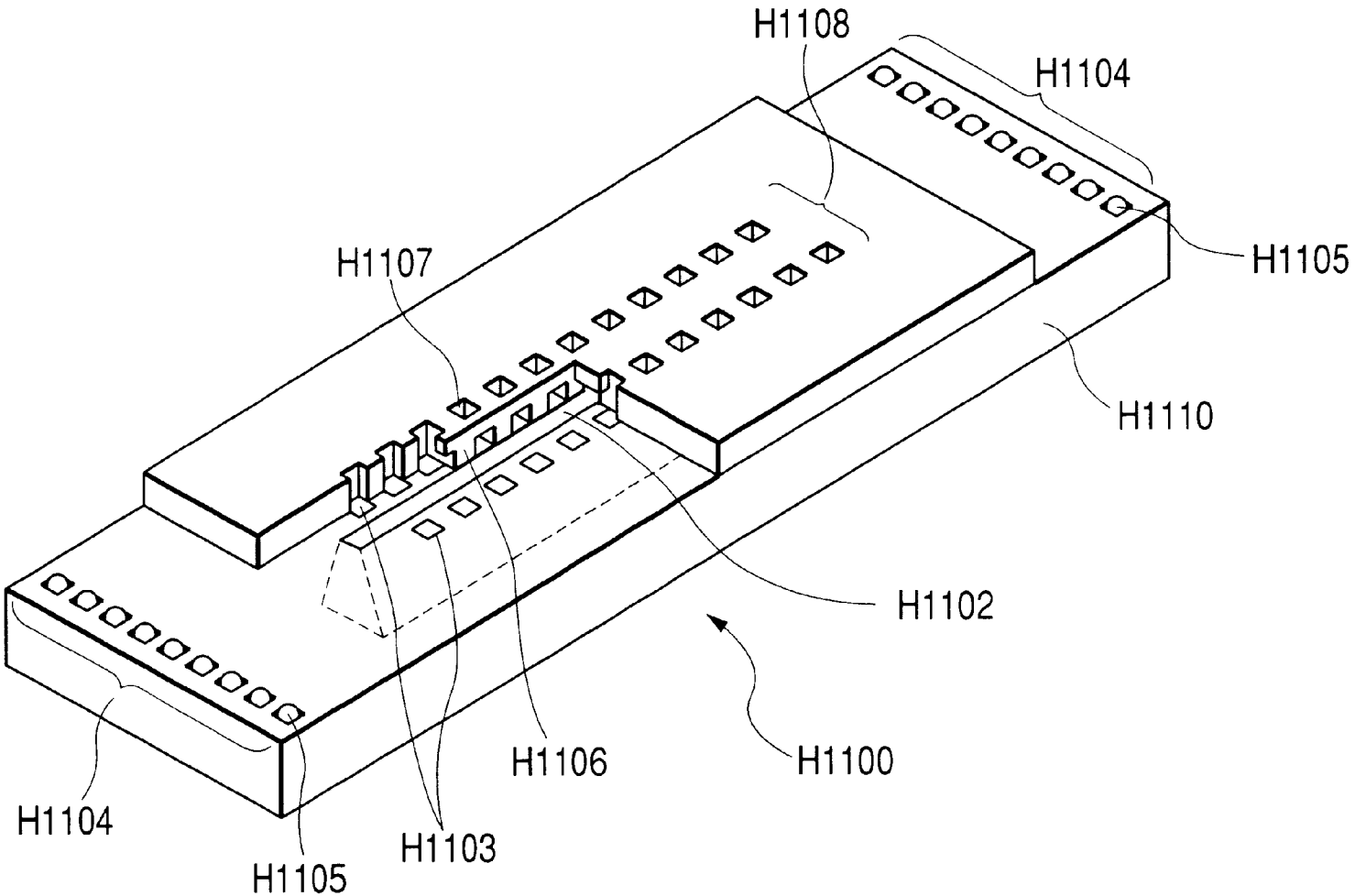
FIG. 4 is a partially broken perspective view which schematically shows a first recording element base plate that constitutes the recording head cartridge embodying the present invention.

FIG. 4 is a partly exploded perspective view which shows the structure of the first recording element base plate H1100. For the first recording element base plate H1100, a plurality of recording elements (electrothermal converting devices) H1103 and electric wiring, such Al, for supplying electric power to each of the electrothermal converting devices H1103 are formed on one side of Si base plate H1110 of 0.5 to 1.0 mm thick by means of film formation technology and technique. Then, a plurality of ink flow paths and a plurality of discharge ports H1107 corresponding to the electrothermal converting devices H1103 are formed by means of photolithographic technology and technique, while the ink supply port H1102 for supplying ink to a plurality of ink flow paths is formed to be open to the face on the opposite side (reverse side). Also, the recording element base plate H1100 is adhesively bonded and fixed to the first plate H1200, and the ink supply port H1102 is formed here, further, to the first plate H1200, the second plate H1400 which is provided with an opening portion is adhesively bonded. Through the second plate H1400, the electric wiring tape H1300 is held to be electrically connected with the recording element base plate H1100. The electric wiring tape H1300 is to apply electric signals to the recording element base plate H1100 for discharge ink, and provided with the electric wiring corresponding to the recording element base plate H1100, and the external signal input terminals H1301 which is positioned in the electric wiring portion to receive electric signals from the printer main body. The external signal input terminals H1301 is positioned and fixed to the reverse side of the ink supply member H1500.

The ink supply port H1102 is formed by means of anisotropic etching, sand blasting, or the like that utilizes the Si crystalline orientation. In other words, if the Si base plate H1110 has the crystal orientation of <100> in the wafer direction, and the crystal orientation of <111> in the thickness direction thereof, the anisotropic etching can be carried out at an angle of approximately 54.7 degrees by use of alkali (KOH, TMAH, hydrazine, or the like). In this way, the etching is made in a desired depth to form the ink supply port H1102 having the through opening in the form of elongated groove. Each one line of the electrothermal converting devices H1103 is arranged in the zigzag form, respectively, on both side across the ink supply port H1102. The electrothermal converting devices H1103 and the electric wiring, such as Al, that supplies electric power to the electrothermal converting devices H1103 are formed by means of the film formation technology and technique. Further, the electrodes H1104 that supply electric power to the electric wiring are arranged on the outer sides of the electrothermal converting devices H1103, respectively, and bumps H1105, such as Au, are formed for the electrodes H1104 by the thermo-ultrasonic pressurized welding method. Then, on the Si base plate H1110, the ink flow path walls H1106 and the discharge ports H1107 are formed with resin material by the photolithographic technology and technique for the formation of ink flow paths corresponding to the electrothermal converting devices H1103, thus forming the discharge port group H1108. Since the discharge ports H1107 are arranged to face the electrothermal converting devices H1103, ink supplied from the ink supply port H1102 is discharged from the discharge ports H1107 by means of the bubbles generated by the heating action of the electrothermal converting devices H1103.

Figure 5:
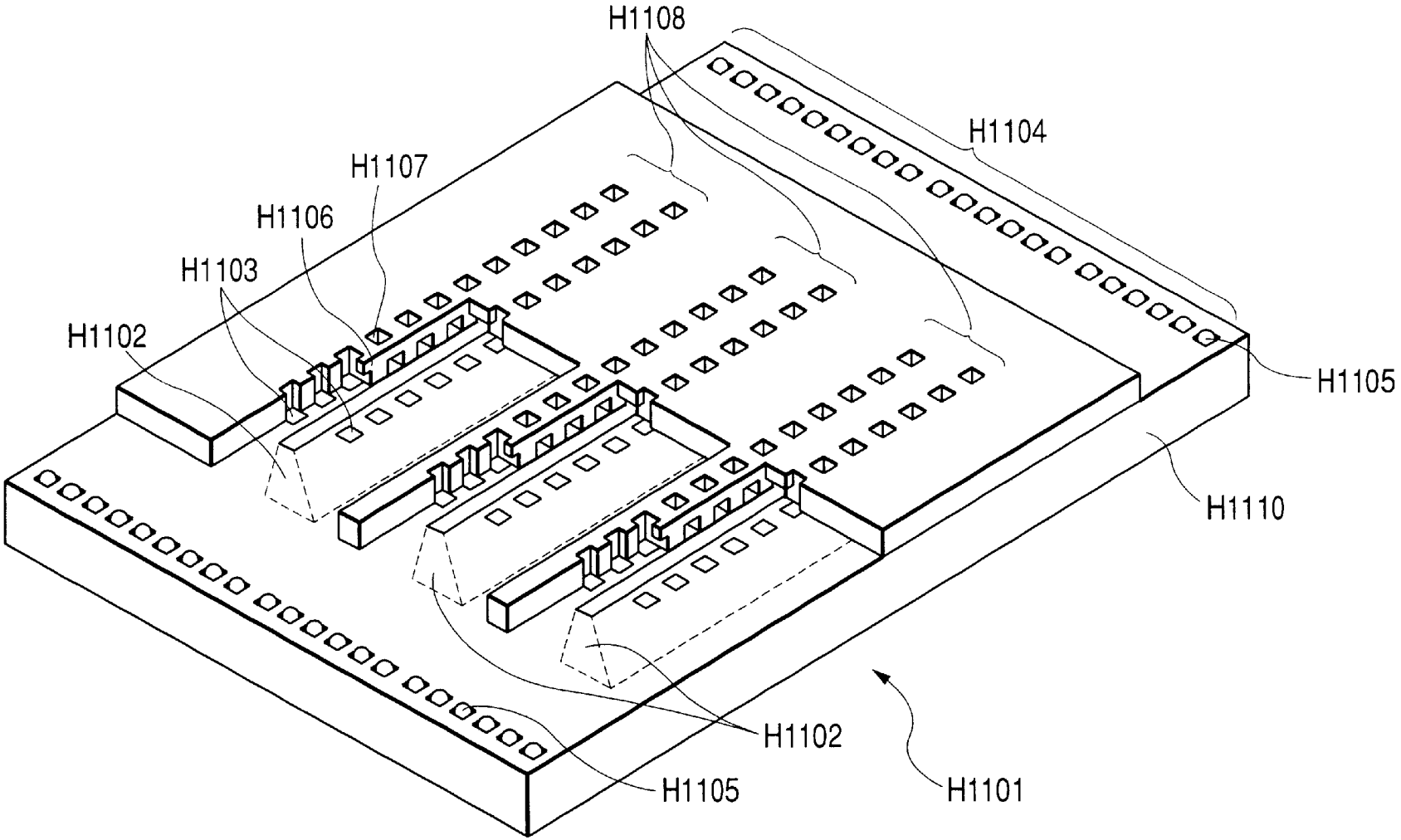
FIG. 5 is a partially broken perspective view which schematically shows a second recording element base plate that constitutes the recording head cartridge embodying the present invention.

Also, FIG. 5 is a partly broken perspective view which illustrates the structure of the second recording element base plate H1101. The second recording element base plate H1101 is the one for discharging ink of three colors. Three ink supply ports H1102 are formed in parallel, and electrothermal converting devices H1103 and ink discharge ports H1107 are formed on both sides having each of the ink supply ports H1102 between them. In the same manner as forming the first recording element base plate H1100, the ink supply ports H1102, electrothermal converting devices H1103, electric wiring, electrodes H1104, and others are formed on the Si base plate H1110, and the ink flow paths and ink discharge ports H1107 are formed on them with resin material by means of the photolithographic technology and technique. Then, as in the case of the first recording element base plate H1100, the bumps H1105 of Au or the like are formed for the electrodes H1104 to supply electric power to the electric wiring.

Now, next, the first plat H1200 is formed by Alumina ($Al_2O_3$) material of 0.5 to 10 mm thick, for example. In this respect, the material of the first plate H1200 is not necessarily limited to alumina, but it may be possible to produce this plate with the material which has the same linear expansion coefficient as that of the material of the recording element base plate H1100, and also, has the same heat conductivity as or more than that of the material of the recording element base plate H1100. The material of the first plate H1200 may be either one of silicon (Si), aluminum nitride (AlN), zirconium, silicon nitride ($Si_3N_4$), silicon carbide (SiC), molybdenum (Mo), and tungsten (W), for example. For the first plate H1200, there are formed the ink supply port H1201 for supplying black ink to the first recording element base plate H1100, and the ink supply ports H1201 for supplying cyan, magenta, and yellow ink to the second recording element base plate H1101. Then, the ink supply ports H1102 of the recording element base plate correspond to the ink supply ports H1201 of the first plate H1200, respectively, and then, the first recording element base plate H1100 and the second recording element base plate H1101 are positioned and bonded to the first plate H1200 to be fixed in good precision. Here, it is desirable to use the first bonding agent which has low viscosity with low hardening temperature so that it can be hardened in a short period of time, while having a relatively high hardness after hardened, and a good resistance to ink as well. Such first bonding agent is, for example, a thermal hardening bonding agent having epoxy resin as its main component, and the thickness of the first bonded layer H1202 shown in FIG. 10 should preferably be 50 $\mu$m or less.

The electric wiring tape H1300 is for the application of electric signals to the first recording element base plate H1100 and the second recording element base plate H1101 for discharging ink, and the electric wiring tape H1300 comprises a plurality of device holes (opening portions) H1 and H2 for incorporating each of the recording element base plates H1100 and H1101; electrode terminals H1302 corresponding to the electrodes H1104 on the respective recording element base plates H1100 and H1101; and the electrode terminals unit to make electrical connection with the electric contact base plate H2200 provided with the external signal input terminals H1301 which is positioned on the edge portion of the wiring tape H1300 for receiving electric signals from the apparatus main body. The electrode terminal unit and the electrode leads H1302 are connected by use of a continuous wiring pattern of copper foil. The electric wiring tape H1300 is formed by the flexible wiring base plate with wires of two-layered structure, and the surface layer thereof is covered by resist film. In this case, on the reverse side (outer face side) of the external signal input terminal H1301, a reinforcement plate is bonded to attempt the enhancement of the flatness thereof. As the reinforcement plate, a heat resistive material, such as glass epoxy, aluminum, or the like in a thickness of 0.5 to 2.0 mm, for example.

The electric wiring tape H1300, the first recording element base plate H1100, and the second recording element base plate H1101 are connected electrically, respectively. The connecting method is, for example, such that the bumps H1105 on the electrodes H1104 of the recording element base pate and the electrode leads H1302 of the electric wiring tape H1300 are electrically coupled by means of thermo-ultrasonic pressurized welding.

The second plate H1400 is, for example, one-sheet plate member of 0.5 to 1.0 mm thick, and formed by ceramics, such as alumina ($Al_2O_3$) or metallic material, such as Al, SUS. However, the material of the second plate H1400 is not necessarily limited thereto. The material may be the one that has the same linear expansion coefficient as that of the recording element base plates H1100 and H1101, and the first plate H1200, and also, has the same heat conductivity as or more than that of these element and plates.

Then, the second plate H1400 is configured to be provided with the opening portion larger than the contour dimension of the first recording element base plate H1100 and the second recording element base plate H1101 which are bonded and fixed to the first plate H1200, respectively. Also, in order to connect the first recording element base plate H1100, the second recording element base plate H1101, and the electric wiring tape H1300 electrically on the plane, the second plate is bonded to the first plate H1200 by means of the second bonding layer H1203, thus bonding and fixing the reverse side of the electric wiring tape H1300 with the third bonding layer H1306.

The electrically connected portions of the first recording element base plate H1100, the second recording element base plate H1101, and the electric wiring tape H1300 are sealed by a first sealant (not shown) and second sealant in order to protect the electrically connected portions from erosion due to ink, and from external shocks as well. The first sealant seals mainly the reverse side of the connected portion between the electrode terminal H1302 of the electric wiring tape and the bumps H1105 of the recording element base plate, and the outer circumferential portion of the recording element base plate. The second sealant seals the surface side of the connected portion described above.

Further, the electric contact base board H2200, which is provided with the external signal input terminal H1301 to receive electric signals from the printer main body, is electrically connected with the edge portion of the electric wiring tape H1300 by means of thermally pressurized bonding using anisotropic conductive film or the like.

Then, at the same time that the electric wiring tape H1300 is bonded to the second plate H1400, the electric wiring tape is folded on one side face of the first plate H1200 and the second plate H1400 to be bonded to the side face of the first plate H1200 by use of the third bonding agent H1306. The second bonding agent should preferably be the one having low viscosity, being capable of forming thin second bonding layer H1203 on the contact face, while having resistance to ink. Also, the third bonding layer H1306 is, for example, a thermo-hardening bonding layer of 10 to 100 $\mu$m thick or less with epoxy resin as its main component.

1-b. Ink Supply Unit

The ink supply member H1500 is formed by means of resin molding, for example. For the resin material thereof, it is desirable to use the resin material in which glass filler is mixed in 5 to 40% to enhance the robustness of the form.

Figure 6:
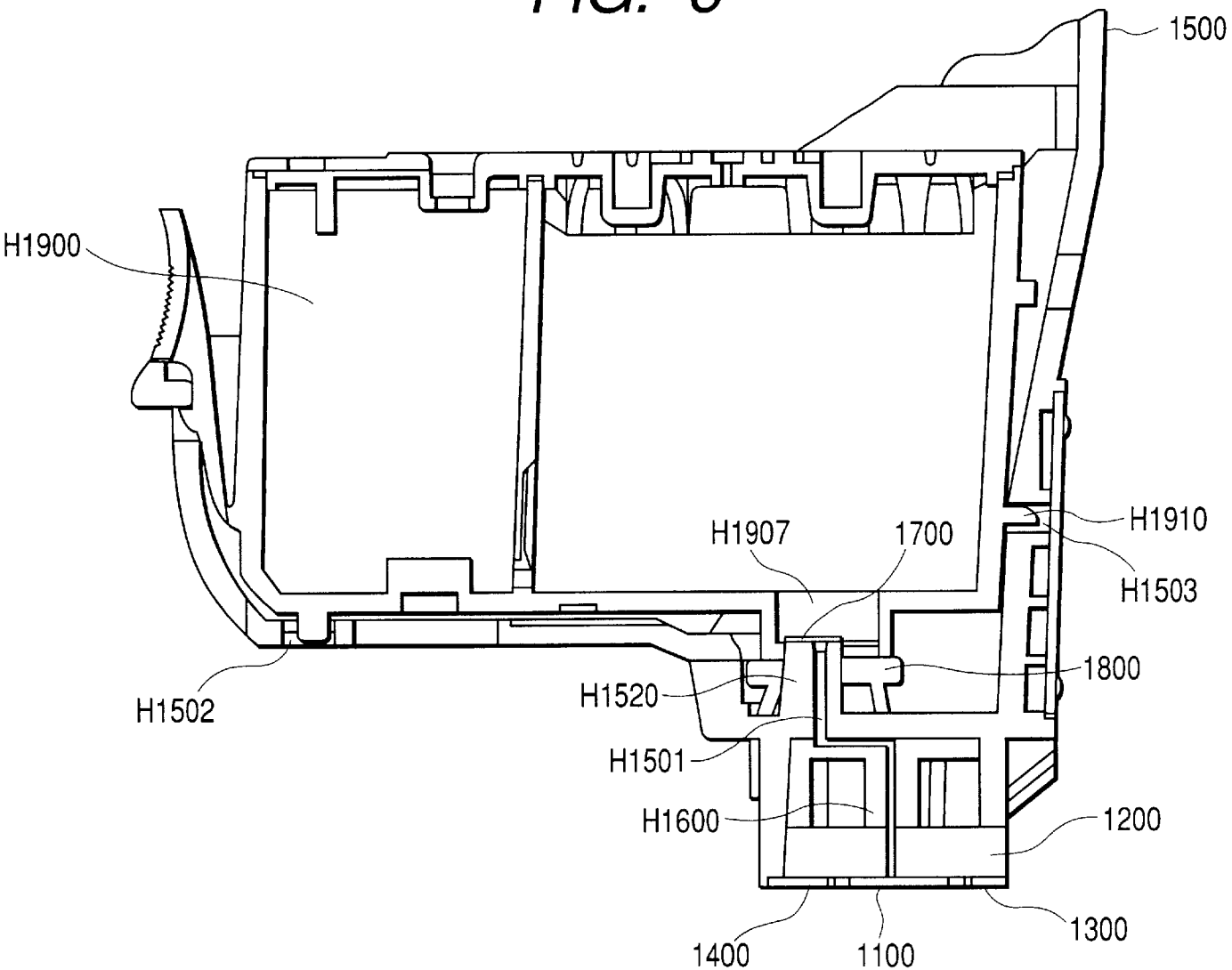
FIG. 6 is a cross-sectional view which shows the principal part of the recording head cartridge embodying the present invention.

As shown in FIG. 3 and FIG. 6, the ink supply member H1500, which holds the ink tanks H1900 to be freely attachable or detachable, is one of the constituents to form the ink supply unit H1003 that conducts ink from the ink tanks H1900 to the recording element unit H1002, and the ink flow paths H1501 are formed from the ink tanks H1900 to the first plate H1200 when the flow path formation member H1600 is welded thereto by means of ultrasonic welding. Also, to the joint portion H1520 coupled with the ink tanks H1900, the filter H1700 is bonded by means of welding in order to prevent external dust particles from entering them. Further, in order to prevent ink evaporation from the joint portion H1520, a sealing rubber H1800 is provided therefor.

Also, the ink supply member H1500 is functioned to hold the freely detachable and attachable ink tanks H1900, and provided with the first hole H1503 which engages with the second nail H1910 of each ink tank H1900.

Also, there are provided an installation guide H1601 to guide the recording head cartridge H1000 to the installing position of the carriage on the main body of an ink jet recording apparatus; the coupling portion where the recording head cartridge is installed and fixed to the carriage by use of a head set lever; an abutting portion H1509 for positioning the carriage in a designated position of installation in the direction X (carriage scanning direction); an abutting portion H1510 in the direction Y (recording medium carrying direction); and an abutting portion H1511 in the direction Z (ink discharging direction). Also, it is arranged to provide the terminal fixing portion H1512 that positions and fixes the electric contact base plate H2200 of the recording element unit H1002. Then, with a plurality of ribs arranged for the terminal fixing portion H1512 and the circumference thereof, the robustness is enhanced for the surface where the terminal fixing portion H1512 is provided.

1-c. Coupling of the Recording Head Unit and the Ink Supply Unit

As described earlier in conjunction with FIG. 2, the recording head H1002 is completed by bonding the recording unit H1001 with the ink supply unit H1003, and further with the tank holder H2000. The bonding is executed as follows:

The ink communication port (ink communication port H1201 of the first plate H1200) of the recording element unit H1002 and the ink communication port (ink communication port H1602 of the liquid flow path formation member H1600) of the ink supply unit H1003 should be communicated without causing any ink leakage. To this end, each of them is fixed by use of screws H2400 to be fixed under pressure with the joint sealing member H2300 between them. Here, at the same time, the recording element unit H1002 is positioned and fixed exactly to the standard positions of the ink supply unit in the direction X, direction Y, and direction Z.

Figure 7:
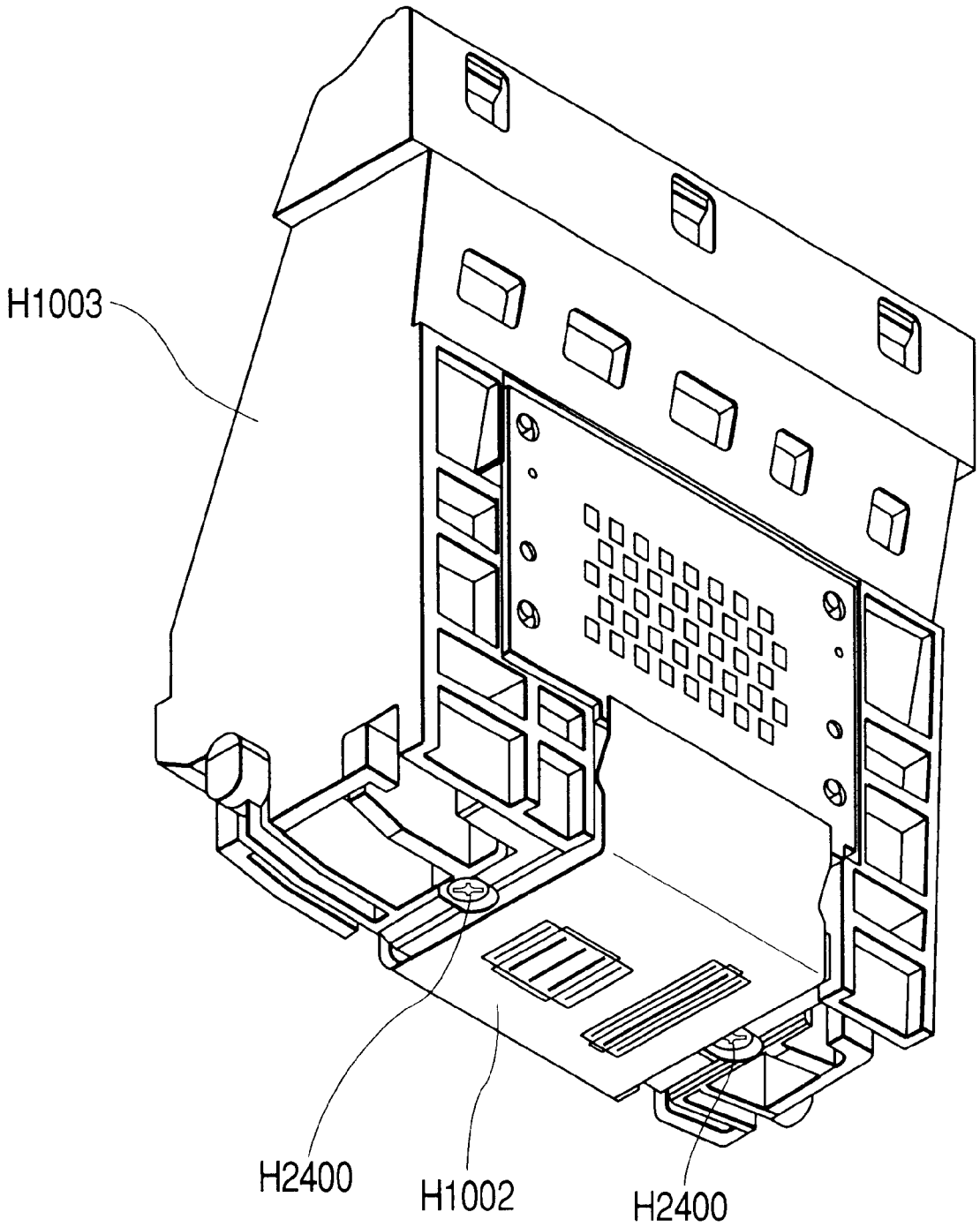
FIG. 7 is a perspective view which shows an assembled body of the recording element unit and the ink supply unit of the recording head cartridge embodying the present invention.

Then, the electric contact base plate H2200 of the recording element unit H1002 is positioned and fixed to one side face of the ink supply member H1500 by use of the terminal positioning pins H1515 (two locations) and the terminal positioning holes H1309 (two locations). The fixing method is, for example, such as to caulk and fix the terminal coupling pins H1515 which is provided for the ink supply member H1500, but any other fixing means may be usable. FIG. 7 shows the finished condition.

Figure 8:
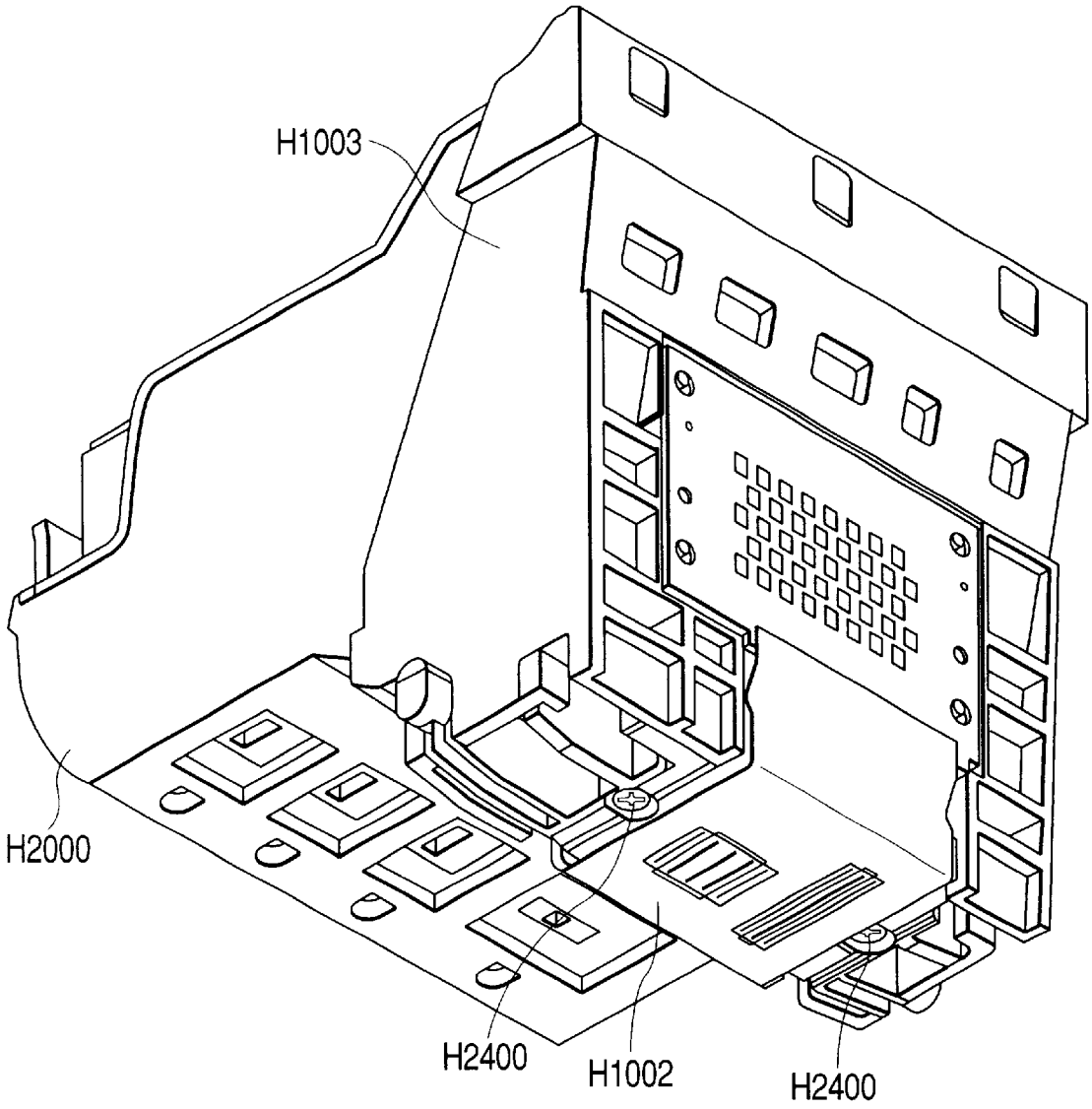
FIG. 8 is a perspective view which shows the bottom side of the recording head cartridge embodying the present invention.

Further, the coupling hole and the portion of the ink supply member H1500 to be coupled with the tank holder are fitted into and coupled with the tank holder H2000 to complete the recording head H1001. In other words, the tank holder unit structured by the ink supply member H1500, the flow path formation member H1600, the filter H1700, and the sealing rubber H1800 are bonded with the recording element unit structured by the recording element base plates H1100 and H1101, the first plate H1200, the wiring base plate H1300, and the second plate H1400 by means of bonding or the like, thus forming the recording head. FIG. 8 shows the completion thereof.

2. Description of Recording Head Cartridge

FIG. 1A and FIG. 1B are views which illustrate the installation of the recording head H1001 and ink tanks H1901, H1902, H1903, and H1904 which constitute a recording head cartridge H1000. Inside the ink tanks H1901, H1902, H1903, and H1904, there are contained ink of corresponding colors, respectively. Also, as shown in FIG. 6, inside each of the ink tanks, the ink communication port H1907 is formed to supply ink retained in the ink tank to the recording head H1001. For example, when the ink tank H1901 is installed on the recording head H1001, the ink communication port H1907 of the ink tank H1901 is in contact under pressure with the filter H1700 installed for the joint portion H1520 of the recording head H1001. Then, black ink in the ink tank H1901 is supplied to the first recording element base plate H1100 from the ink communication port H1907 through the first plate H1200 by way of the ink flow path H1501 of the recording head H1001.

Then, ink is supplied to the bubbling chamber where the electrothermal converting device H1103 and the discharge port H1107 are arranged, and ink is discharged toward a recording sheet serving as a recording medium by the application of thermal energy generated by the electrothermal converting device H1103.

3. Variational Example of the Second Recording Element Base Plate

Figure 9A:
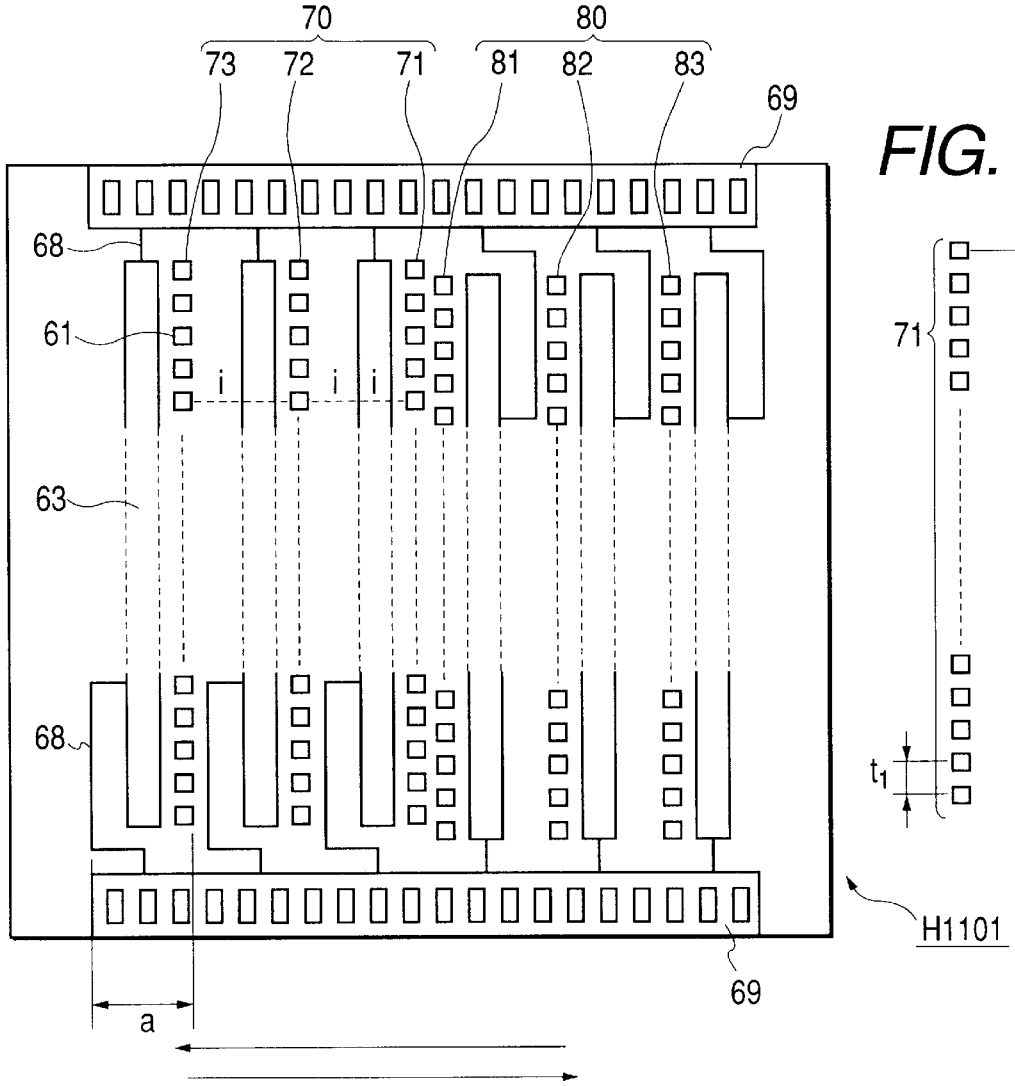
FIGS. 9A, 9B, and 9C are views which illustrate the variational example of the second recording element base plate that constitutes the recording head cartridge embodying the present invention.
Figure 9B:
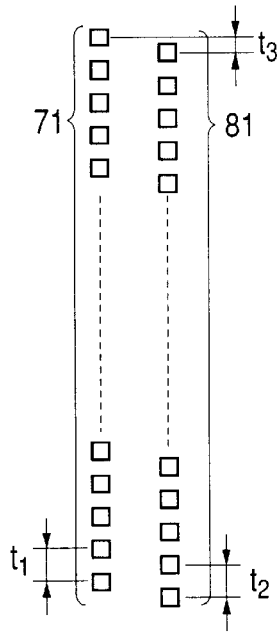
Figure 9C:
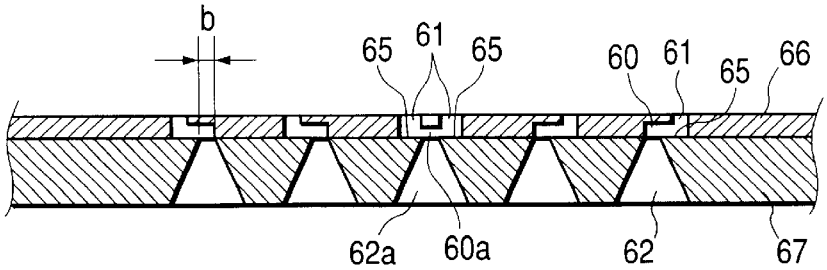
Figure 10:
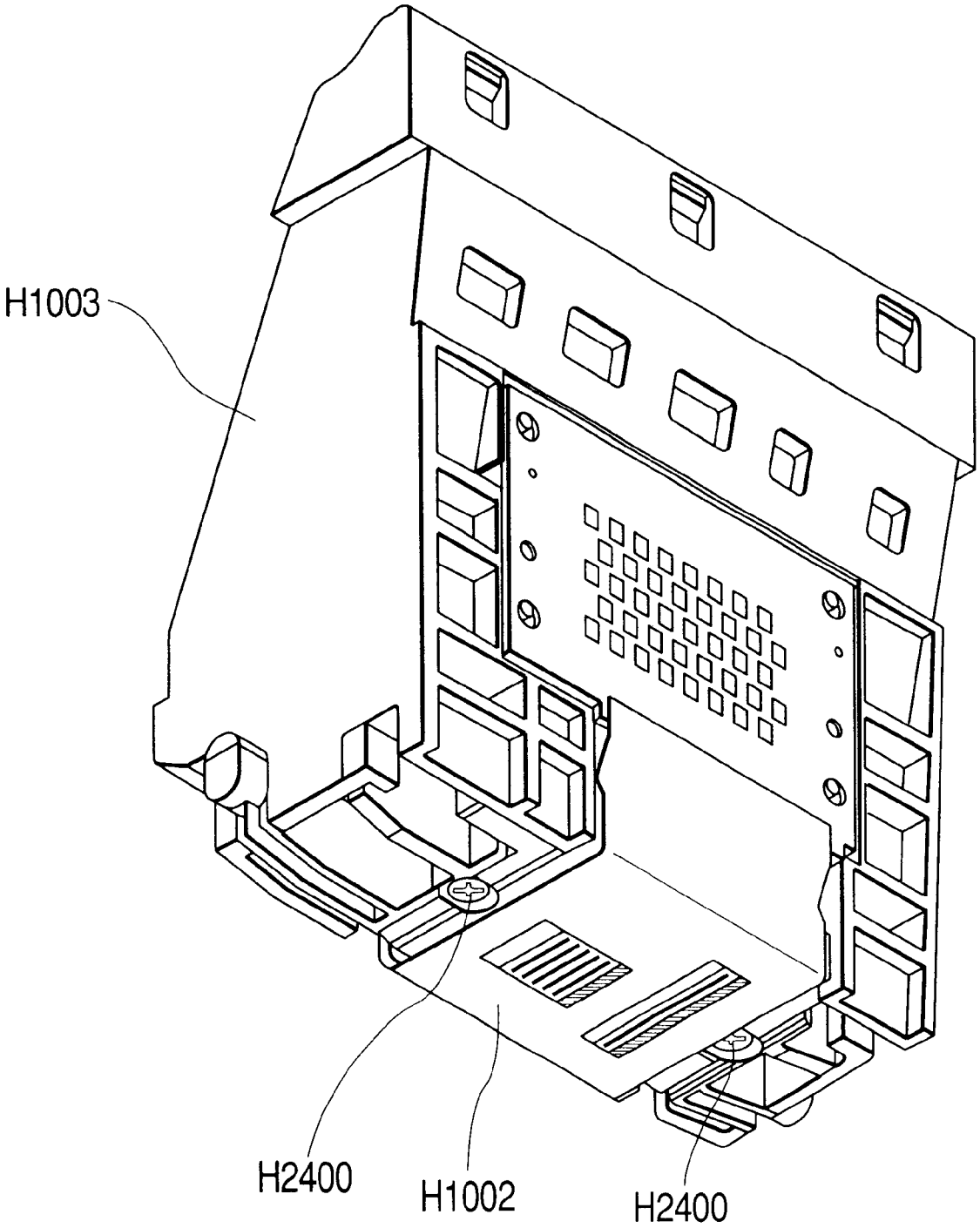
FIG. 10 is a perspective view which shows the assembled body of the recording element unit and the ink supply unit having the second recording element base plate represented in FIGS. 9A to 9C.
Figure 11:
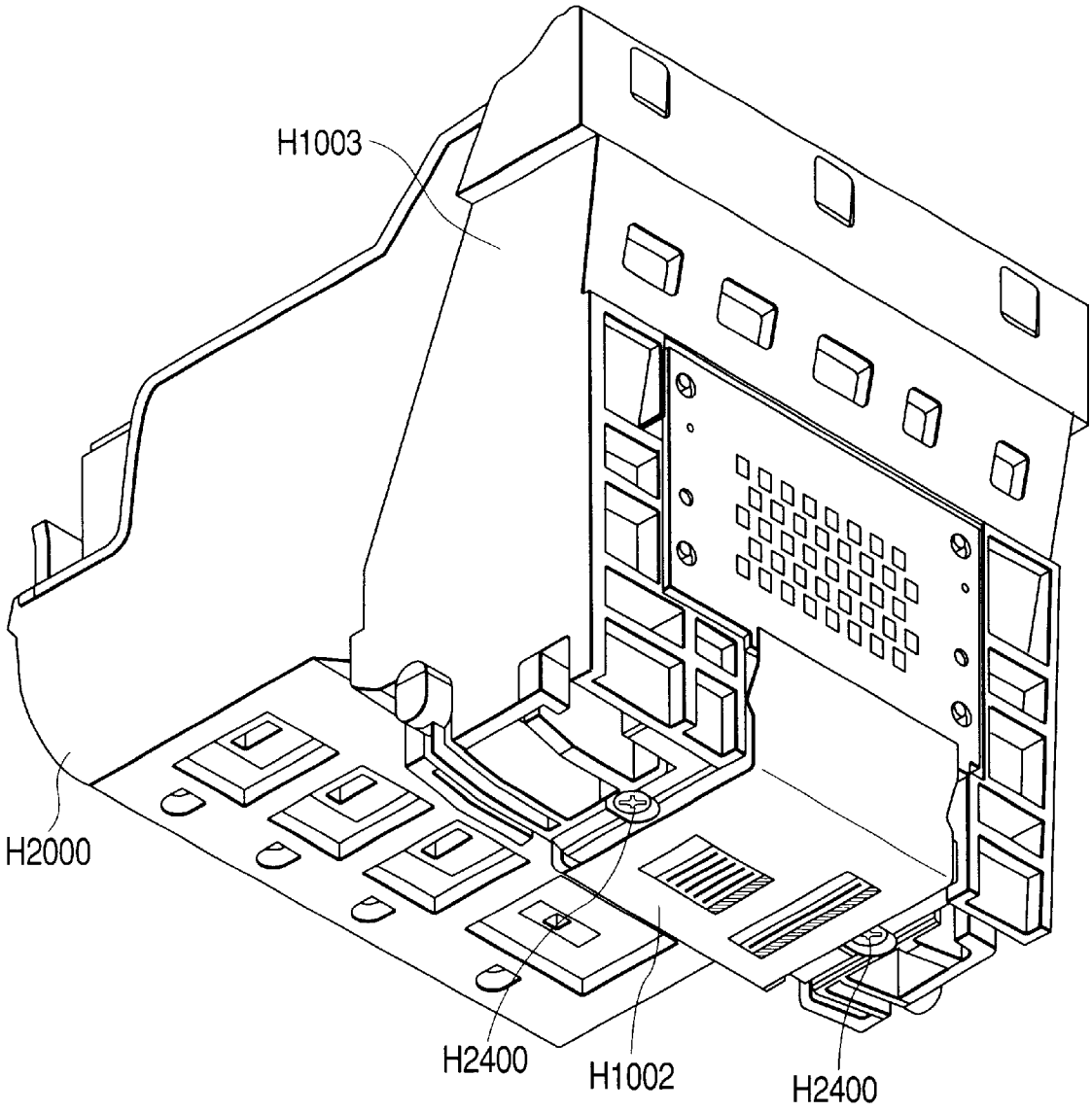
FIG. 11 is a perspective view which shows the bottom side of the recording head cartridge structured by use of the second recording element base plate represented in FIGS. 9A to 9C.

FIGS. 9A, 9B, and 9C are views which illustrate the variational example of the second recording element base plate H1101. FIG. 9A is a front view. FIG. 9B is a partially enlarged view of the base plate shown in FIG. 9A. FIG. 9C is a cross-sectional view. Also, FIG. 10 and FIG. 11 are views which illustrate the base plate incorporated in a recording head, and each of them corresponds to FIG. 7 and FIG. 8, respectively.

As typically represented in FIG. 9C, the second recording element base plate H1101 used for color printing comprises the base plate 67 that includes the heat generating resistive elements 65 serving as the energy converting devices, and the orifice plate 66 that forms discharge ports 61. The base plate 67 is formed by silicon monocrystal having the surface orientation of <100>, and on the base plate 67, a plurality of heat generating resistive element lines 65, a driving circuit 63 for driving the heat generating resistive elements 65 of each line, contact pads 69 for the external connection, a wiring 68 for connecting the driving circuit 63 and contact pads 69, among some others, are formed by means of the semiconductor process. Also, on the base plate 67, the five through ports, which are formed by the anisotropic etching, are arranged on the area excluding the aforesaid circuit 63, elements 65, wiring 68, and the like. Each of them forms the ink supply ports 62 and 62a for supplying liquid to the discharge port arrays 71 to 73 and 81 to 83, respectively, as described later. Here, FIG. 9A schematically shows the state where an almost transparent orifice plate 66 is formed for the baseplate 67. The aforesaid heat generating resistive element and ink supply ports are omitted in the representation here.

The orifice plate 66 arranged on the base plate 67 is formed by photosensitive epoxy resin, and the discharge ports 61 and liquid flow paths 60 are formed by use of the photolithographic technology and technique corresponding to the aforesaid heat generating resistive elements 65.

Also, with the contact pads 69 being connected with the electrode terminals of the electric wiring tape (at H1300 in FIG. 3), the recording element base plate H1101 can receive driving signals and others from the recording apparatus when the external signal input terminal connected with this wiring tape is coupled with the electric connector of the recording apparatus. Further, the ink supply ports 12, 12*a* and others are communicated respectively with ink tanks of each color through each ink flow path of the flow path formation member (at H1600 in FIG. 3) of the ink supply unit.

Also, a plurality of discharge ports 61 are provided and arranged at designated pitches, thus forming the discharge port lines (discharge portions) 71 to 73 and 81 to 83 substantially in parallel to each other. Here, in FIG. 9A, each of the ith discharge ports of the discharge port lines 71 to 73 in FIG. 9A is identical in the direction indicated by arrows shown in FIG. 9A. In this way, the discharge port lines 71 to 73 are arranged to make each of the corresponding discharge ports identical in the scanning direction of the recording head cartridge H1000 which is mounted on the recording apparatus or the like to perform scanning, thus forming a first group 70 of discharge port lines. The discharge port lines 81 to 83 are also arranged in the same manner as the discharge port lines 71 to 73, and with the discharge port lines 81 to 83, a second group 80 of discharge port lines is formed adjacent to the first group 70 of discharge port lines.

For the six discharge port lines formed by two groups of discharge port lines, it is assumed that the outermost discharge port lines 73 and 83 discharge cyan (C); the discharge port lines 72 and 82 discharge magenta (M); and the innermost discharge port lines 71 and 81, which are adjacent to each other, discharge yellow (Y). Consequently, yellow ink is supplied form each of the individual ink tanks Y, M, C to the ink supply port 62*a* (ink supply port arranged on the central portion); magenta ink is supplied to the two ink supply ports 62 adjacent to the ink supply port 62; and cyan ink to the two outermost ink supply ports 62, respectively. In this manner, the central ink supply port 62*a* supplies liquid to two discharge port lines 71 and 81. Therefore, the ink supply port 62*a* and the liquid flow path 60*a* function as the common liquid chamber for these two discharge port lines 71 and 81.

As described above, the discharge port lines, each discharging the same kind of liquid, are arranged for the portions of two discharge port lines being adjacent. Then, substantially in symmetry having this portion in center, the other discharge port lines of the same kind and the driving circuit therefor are arranged, and the through ports serving as the ink supply ports 62 and 62*a*, driving circuits, heat generating resistive elements, and others are arranged on the base plate at the same pitches without any waste. In this way, the size of the base plate can be made smaller. Further, with the discharge port lines that discharge the same kind of liquid being arranged in linear symmetry, it becomes possible to make color development uniform at the time of reciprocal recording (bidirectional printing) irrespective of the scanning directions and prevent unevenness from being created in the recorded images due to reciprocal printing, because the order of ink shooting (discharging) per pixel for the formation of a desired color on a recording medium is the same in the forward scanning and backward scanning.

Further, as clear from FIG. 9A and FIG. 9B, the first group 70 of discharge port lines and the second group 80 of discharge port lines are arranged to be deviated from each other just by ½ pitch of the discharge port arrangement with respect to the sub-scanning direction of the recording head (identical to the arrangement direction of the discharge port lines for the present example) so that each of the discharge ports of the discharge port lines 71 to 73 and 81 to 83 which form each of the discharge port groups can complement mutually in the aforesaid scanning directions. In other words, in FIG. 9B, the pitch $t_1$ of the discharge port line 71 and the pitch $t_2$ of the discharge port line 81, and deviated width $t_3$ between the discharge port line 71 and the discharge port line 81 in the arrangement direction of the discharge ports are made to satisfy the relationship of $t_1=t_2=2t_3$, hence making it possible to perform a highly precise printing which is substantially two times the pitches of the discharge port arrangement.

Further, the second recording element base plate H1101 arranges the density of the electrothermal converting devices 65 to be 1200 dpi, and sets the amount of color liquid droplet at 4 to 8 l; (pico liter, $10^{-12}$ liter). On the other hand, for the first element base board H1100 shown in FIG. 4, the arrangement density of the electrothermal converting devices is set at 600 dpi, and the amount of black liquid droplet is set at 20 to 40 pl (picoliter, $10^{-12}$ liter).

Therefore, the size of each electrothermal converting device 65 of the second recording element base plate H1101 is smaller than that of each electro-thermal converting device of the first recording element base plate H1100. Also, the size of each discharge port 61 is smaller than the discharge port H1100 of the first recording element base plate H1100. For the first recording element base plate H1100, for example, the distance OH between the discharge port and the electrothermal converting device is 60 to 80 $\mu$m, the area $S_o$ of the discharge port is 150 to 400 $\mu m^2$, and the area $S_H$ of the electrothermal converting device is 1200 to 1600 $\mu m^2$ in order to obtain black letter of 30 pl. For the second recording element base plate H1101, the OH is 20 to 40 $\mu$m, the $S_o$ is 500 to 750 $\mu m^2$, and the $S_H$ is 400 to 700 $\mu m^2$ to obtain color of 5 pl. This condition is the same for the recording element base plate shown in FIG. 4 and FIG. 5.

Now, the recording element unit shown in FIG. 10 and, further, the recording head cartridge shown in FIG. 11 are assembled by use of the second recording element base plate H1101 shown in FIGS. 9A to 9C, the first plate H1200 described with reference to FIGS. 1A and 1B to FIG. 6, and the first recording element base plate H1100, and then, by bonding the recording element base plates H110 and H1101 onto the first plate H1200 for fixation.

As described above, for the base plate (heater board) of the ink jet recording head, having thereon the heat generating resistive elements and wiring circuits described with reference to FIGS. 1A and 1B, and FIG. 2 to FIG. 11, there are provided temperature detecting means for detecting the temperature of the heater board, and the heat generating resistive elements (sub-heaters) serving as means for heating the base plate in order to control temperature to make the temperature distribution of the heater board uniform in accordance with the detection result of the temperature detecting means. With the adoption of the sub-heater structure thus arranged, the "initial discharge performance" becomes better as described earlier. As a result, it is made possible to reduce the frequency of the event to necessitate the discharge recovery process that invites the increased amount of ink consumption. However, since the heater board is provided with many numbers of heaters, plural ink supply ports, and wiring circuits, it should be attempted to find the efficient arrangement of the sub-heaters and temperature detecting means in order to obtain the good "initial discharge performance" and the stabilized color tone of recorded images. In addition, the provision of temperature detecting means, the number of sub-heaters, and the increased area of the heater board inevitably make the recording head larger and invite the cost increase. Therefore, the layout consideration should be given to the arrangement of temperature detecting means and sub-heaters in order to minimize the possible increase of the area of the heater board.

Now, hereunder, the description will be made of the various examples of the layout of the sub-heaters and temperature detecting means arranged for the uniform heat distribution on the base plate. Here, for the description thereof, the same reference marks are applied to the same parts as those described earlier.

First Embodiment

Figure 12:
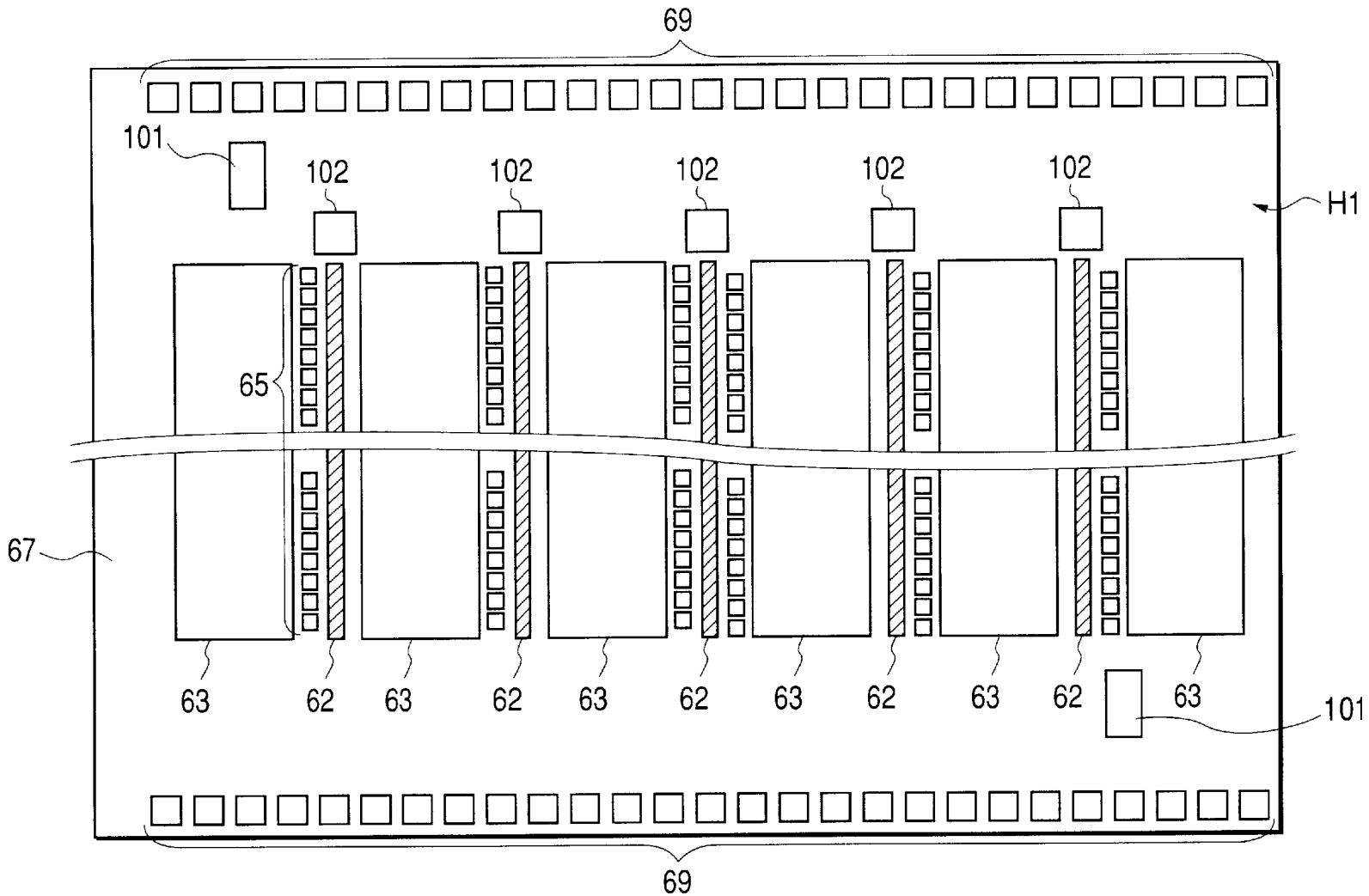
FIG. 12 is a view which shows the layout in a heater board of the ink jet recording head in accordance with a first embodiment of the present invention.

FIG. 12 is a view which shows the layout on the heater board of an ink jet recording head in accordance with a first embodiment of the present invention.

The heater board H1 shown in FIG. 12 corresponds to the base plate 67 provided with the heat generating resistive elements (heaters) 65 formed on the recording element base plate H1101 represented in FIGS. 9A to 9C. This heater board H1 is characterized in that plural lines (six lines for the present example) of the heat generating resistive elements 65 corresponding to the discharge ports for use of plural colors, the driving circuits 63 for driving each line of heat generating resistive elements 65, the contact pads 69 for external connection, and others are formed on one base plate 67. Further, on the area of the heater board H1 other than the aforesaid circuits 63, elements 65, pads 69, and others, five elongated through openings are arranged as the ink supply ports used for plural colors. In order to manufacture the recording head at as lower costs as possible, too, it is required to make the area itself smaller for the heater board structured as described above. Therefore, the area occupied by those other than the heaters 65 should be made as small as possible as a matter of course. As far as the enhancement of the uniform temperature distribution by the control of sub-heaters is concerned, the smaller area of the heater board itself produces more favorable effect.

However, the heater board H1 is provided with the elongated ink supply ports corresponding to plural colors. For that matter, the ink supply portion thus arranged indicates the heat insulating characteristics with respect to the heater board material. Then, there is a fear that this condition causes the heat radiating action and heat transferability to be deteriorated, and that the desired effect anticipated by the layout of the sub-heaters is not obtained satisfactorily.

For example, if one sub-heater 101 is installed only on one end portion of the heater board H1 in the structure shown in FIG. 12, it is difficult to keep the uniformity of temperature distribution of the heater board, and there is a possibility that the desired effect of the sub-heater 101 cannot be obtained satisfactorily.

In contrast, for the present embodiment, the sub-heaters 101 are arranged on the two locations, respectively, in the vicinity of both end portions of the ink supply ports 65 on the heater board H1 in the longitudinal direction, which are on the symmetrical line of the heater board H1, so as to keep the temperature distribution uniformly in the base plate. In this way, it becomes possible to keep the temperature distribution as uniform as possible in the heater board H1 without being affected by a plurality of ink supply ports 65 and many numbers of heaters 65.

Also, this makes it possible to reduced the numbers of temperature detecting (temperature measuring) means to be arranged on the base plate to control temperature, and also, to widen the degree of freedom of the arrangement locations thereof.

In FIG. 12, each of the temperature detecting means 102 is arranged only on one side in the vicinity of each end portion of the ink supply ports 105 in the longitudinal direction. With the arrangement of sub-heaters 101 in the way as described earlier, the uniformity of temperature distribution is effectively kept for the heater board H1, and then, the degree of freedom of arrangement increases for temperature detecting means to make it unnecessary to provide the temperature detecting means 102 on both end portions in the longitudinal direction, and the central portion of each ink supply port 105. Thus, with the minimum number of temperature detecting means to be arranged, it becomes possible to detect the temperature of the heater board H1. Also, with temperature detecting means 102 arranged on the end portion of each ink supply port 105 in the longitudinal direction, it becomes possible to measure the temperature as accurately as possible in the vicinity of the circumferential portion of each ink supply port where the heat generating resistive element is arranged.

Figure 13A:
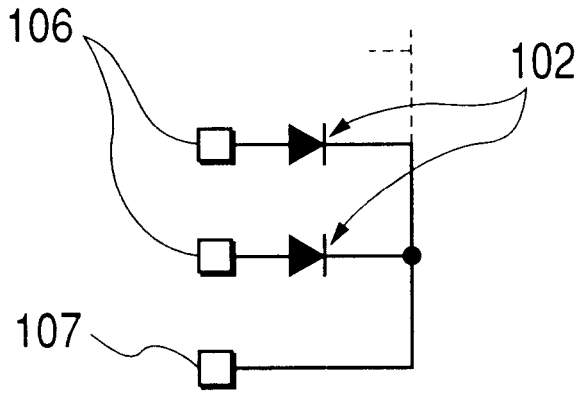
FIGS. 13A and 13B are the structural views which schematically illustrate temperature detecting means and sub-heater on a heater board serving as the base plate for use of the recording head of the present invention.
Figure 13B:
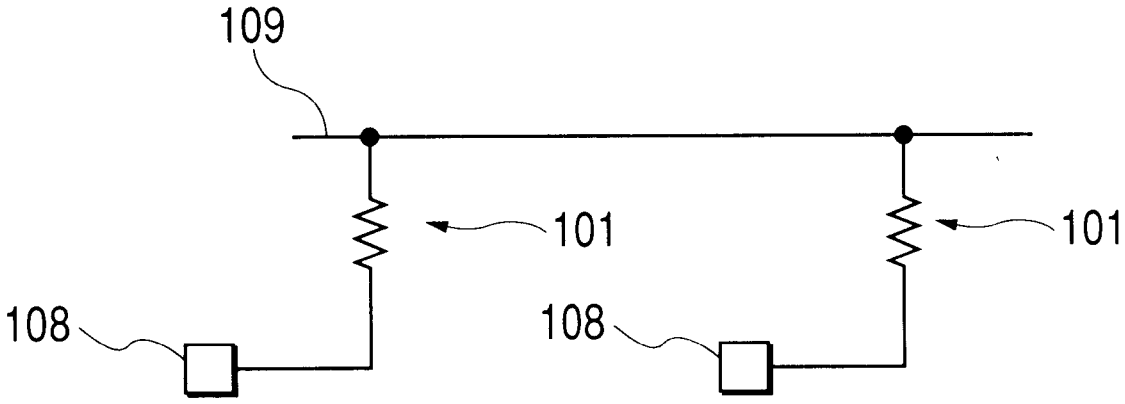

Here, as shown in FIG. 13A, the diode sensor which changes temperature characteristics (that is, the resistive values change depending on temperatures) is used for temperature detecting means 102. Then, in the case where a plurality of temperature detecting means are arranged, one end of each of the diode sensors themselves is connected commonly to the cathode terminal 107, and the other end of each of the diode sensors is connected to each of the anode terminals 106 individually. Also, a heat generating resistive element as shown in FIG. 13B is used as the sub-heater 101. Then, in the case where a plurality of sub-heaters are arranged, one end of each of the sub-heaters is commonly connected to a heater power supply source 109, and the other end of each of sub-heaters is connected to each of the sub-heater terminals 108 individually.

As described above, in the heater board structured as shown in FIG. 12, the temperature detecting means and sub-heaters are arranged in accordance with the aforesaid layout, hence making it possible to manufacture at as lower costs as possible a small recording head capable of measuring the temperature of the base plate and efficiently performing the temperature control of the base plate in accordance of such measurement.

Second Embodiment

Figure 14:
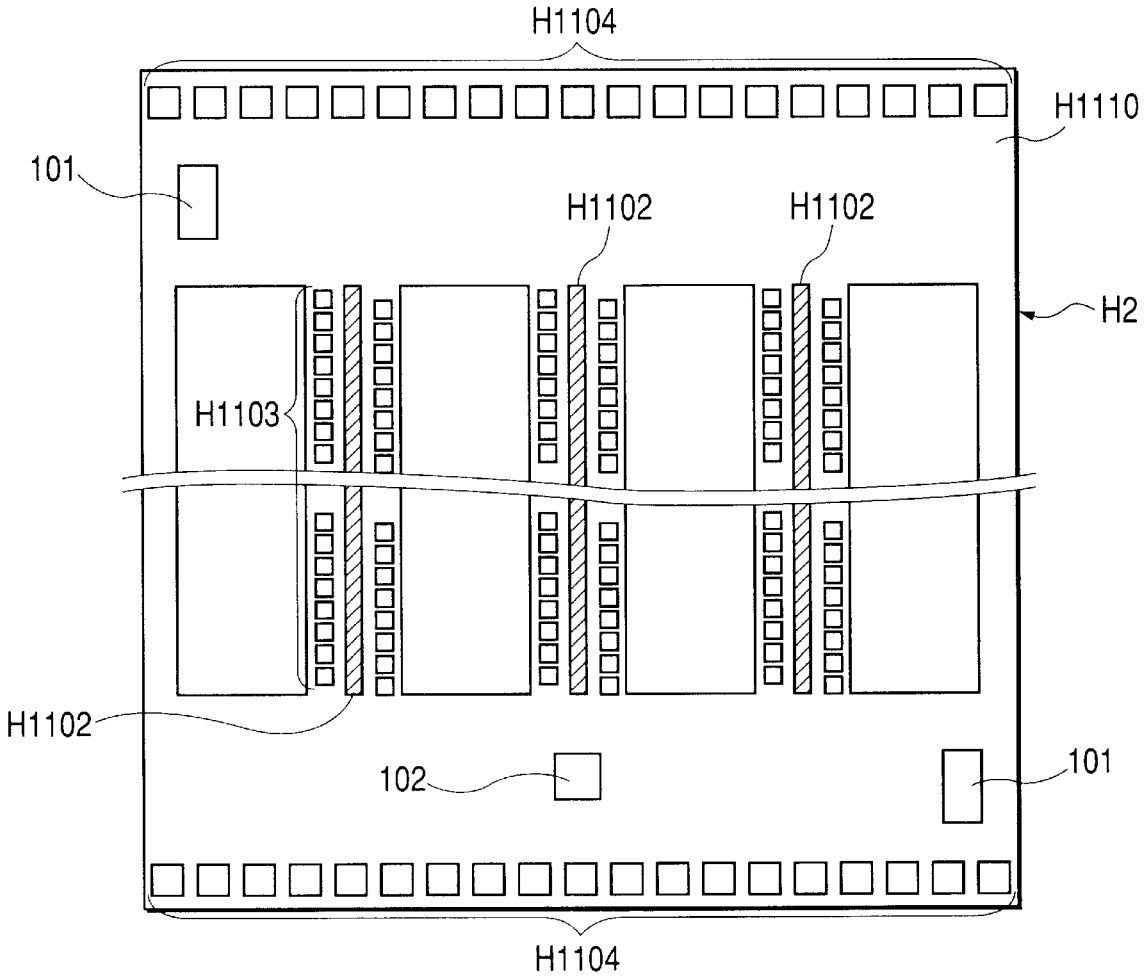
FIG. 14 is a view which shows the layout in the heater board of an ink jet recording head in accordance with a second embodiment of the present invention.

FIG. 14 is a view which shows the layout on the heater board of an ink jet recording head in accordance with a second embodiment of the present invention.

The heater board H2 shown in FIG. 14 corresponds to the Si base plate H1110 provided with the electrothermal converting devices (heaters) H1103 for the recording element base plate H1101 represented in FIG. 5.

For the present embodiment, too, the sub-heaters 101 are arranged for the two locations on the symmetrical line of the heater board H2 in the vicinity of both end portions of the heater board H2 in the longitudinal direction of the ink supply ports H1102 as in the first embodiment in order to keep the temperature distribution uniformly in the base plate. Thus, it is made possible to maintain the temperature distribution uniformly in the heater board H2 without being affected by a plurality of ink supply ports H1102 and many numbers of heaters H1103.

Also, in FIG. 14, only one temperature detecting means 102 is arranged in the vicinity of end portion on one side of the central ink supply port 105 in the longitudinal direction. This is because the size of the base plate is smaller than the one in the mode of the first embodiment. Moreover, with the arrangement of the sub-heaters 101 as described earlier, the uniformity of the temperature distribution of the heater board H2 can be kept effectively to increase the degree of freedom for the arrangement of temperature detecting means to make it unnecessary to arrange temperature detecting means 102 for the end portion of each ink supply ports 105 in the longitudinal direction, and near the central portion thereof. The temperature detection of the heater board H2 can be carried out with the minimum temperature detecting means.

As described above, in the heater board structured as shown in FIG. 14, too, the temperature detecting means and sub-heaters are arranged in accordance with the aforesaid layout, hence making it possible to manufacture at as lower costs as possible a small recording head capable of measuring the temperature of the base plate and efficiently performing the temperature control of the base plate in accordance of such measurement.

Third Embodiment

Figure 15:
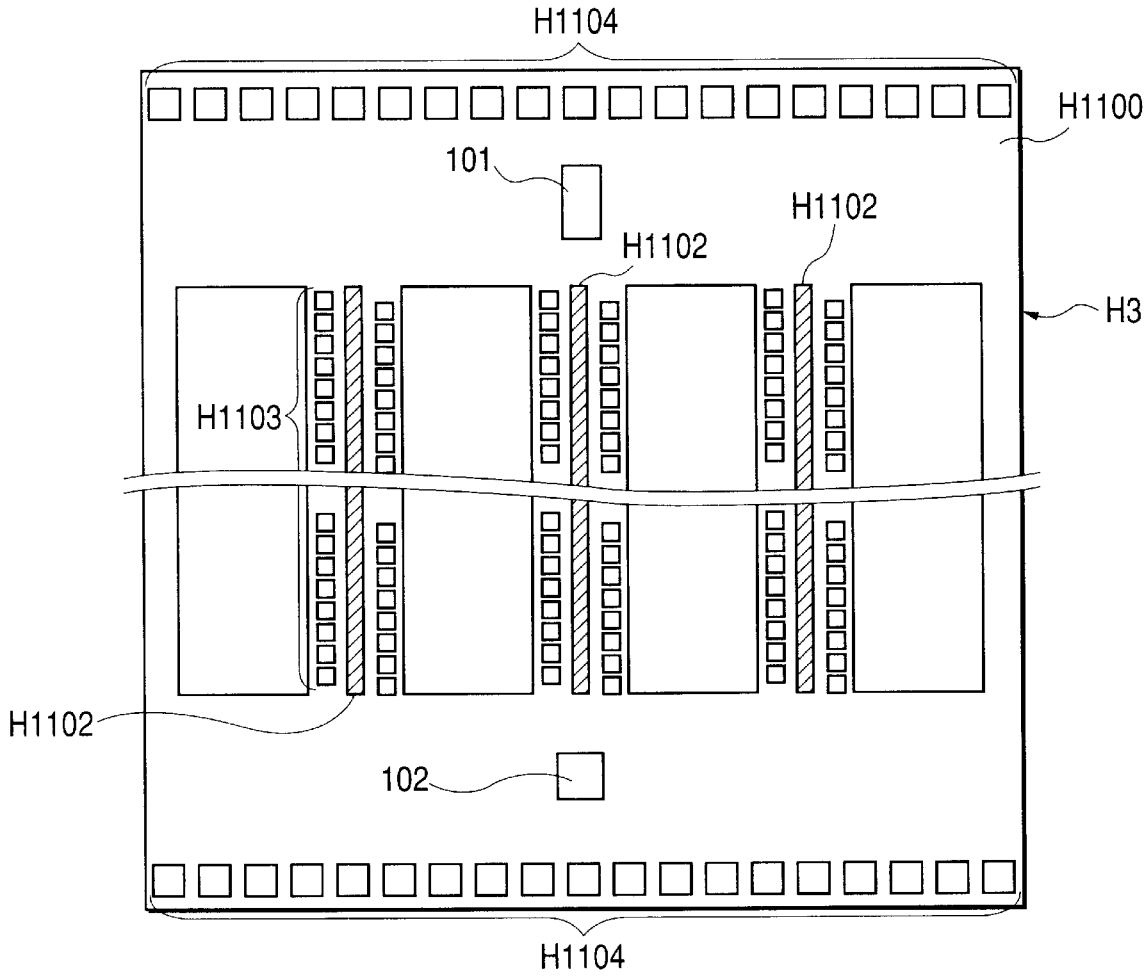
FIG. 15 is a view which shows the layout in the heater board of an ink jet recording head in accordance with a third embodiment of the present invention.

FIG. 15 is a view which shows the layout on the heater board of an ink jet recording head in accordance with a third embodiment of the present invention.

The heater board H3 shown in FIG. 15 corresponds to the Si base board H1110 provided with the electrothermal converting devices (heaters) H1103 of the recording element base plate H1101 represented in FIG. 5.

When the size of the base plate is still smaller than the one in the mode of the first embodiment as in the present embodiment, it may be good enough to arrange the structure in which the temperature distribution of the heater board H3 is kept uniformly but not necessarily arranging a plurality of sub-heaters. Also, in order to manufacture a recording head at as lower costs as possible, too, it is effective to make the area of the heater board occupied by those other than the heaters H1103 as small as possible. In this case, therefore, the sub-heater 101 is arranged only one location in the vicinity of the end portion of one side of the central ink supply port H1102 in the longitudinal direction on the heater board H3. For the present embodiment, the sub-heater 101 is arranged on one location in the vicinity of the end portion of the central ink discharge port H1102 on the heater board H3 in the longitudinal direction. In this way, it is made possible to keep the temperature distribution in the heater board H3 as uniform as possible without being affected by a plurality of ink supply ports H1102 and many numbers of heaters H1103.

Also, this arrangement makes it possible to reduce the number of temperature detecting (temperature measuring) means to be arranged on the base plate for controlling temperature, and to widen the degree of freedom with which the locations thereof can be determined.

In FIG. 15, temperature detecting means 102 is arranged only in the vicinity of the end portion on the one side of the ink supply port H1102 positioned in the center of the heater board H3 in the longitudinal direction. This is because, as described earlier, with the higher effect of the sub-heater 101 to keep the uniformity of the temperature distribution of the heater board H3, it becomes unnecessary to arrange diode sensors 102 on both ends of each ink supply port 105 in the longitudinal direction and in the vicinity of the central portion of the heater board H3. Also, for the arrangement locations of temperature detecting means, it is made possible to detect the temperature of the heater board H3 by arranging temperature detection means 102 only one location in the vicinity of the end portion on the side opposite to the side where the sub-heater 101 is arranged among end portions of ink supply ports H1102 in the longitudinal direction. This produces further effect on making the area of the heater board H3 as small as possible.

Here, as temperature detecting means 102, the diode sensor structured as shown in FIG. 13A, which changes temperature characteristics, is used, and also, as the sub-heater 101, the heat generating resistive element structured as shown in FIG. 13B can be used.

As described above, in the heater board structured as shown in FIG. 15, the size of the base plate of which is still smaller than the first embodiment, the temperature detecting means and sub-heaters are arranged in accordance with the aforesaid layout, hence making it possible to manufacture at as lower costs as possible a small recording head capable of measuring the temperature of the base plate and efficiently performing the temperature control of the base plate in accordance of such measurement.

Other Embodiment

Figure 16:
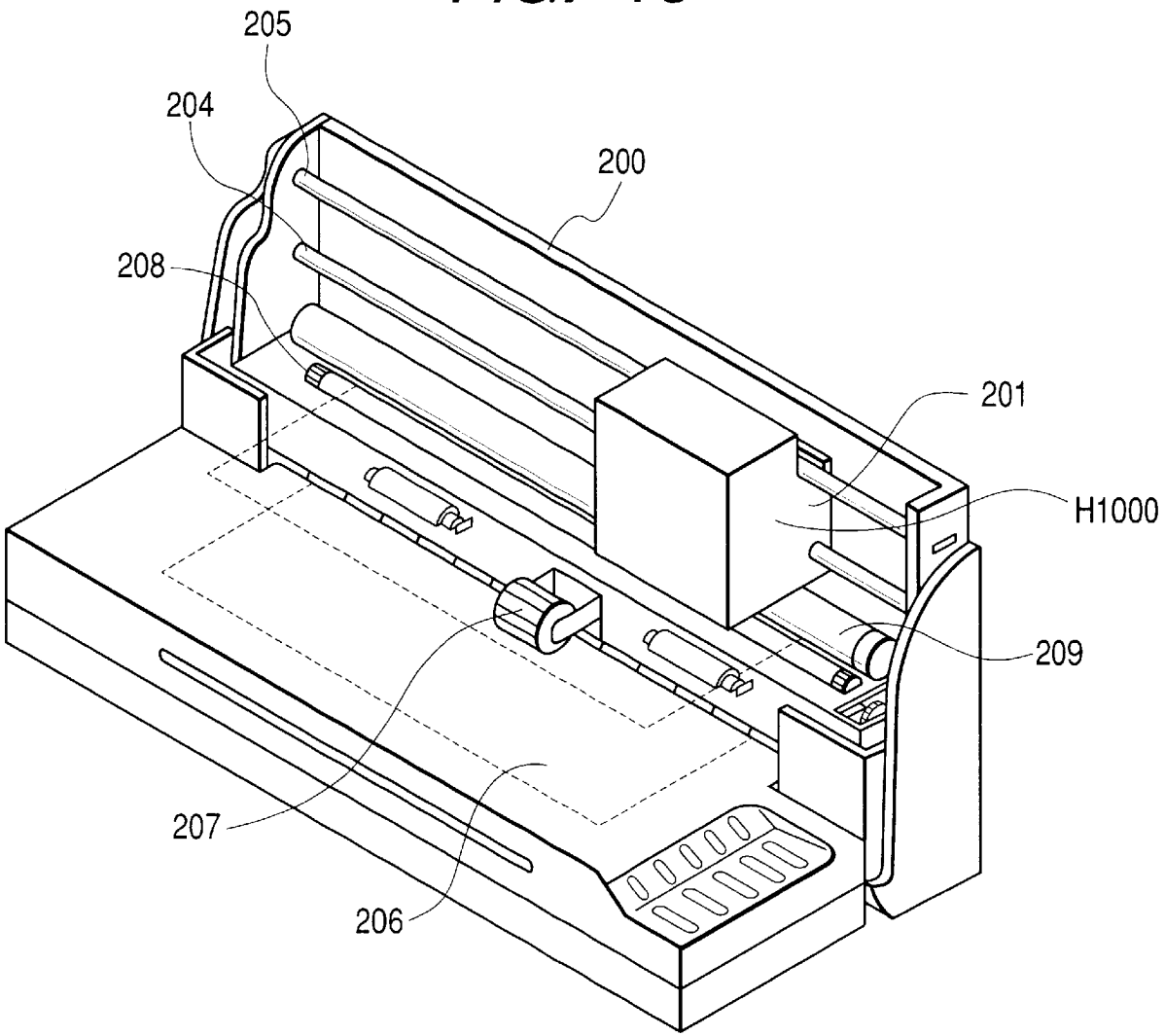
FIG. 16 is a perspective view which shows the outline of an ink jet recording apparatus in accordance with the present invention.

FIG. 16 is a perspective view which shows the ink jet recording apparatus that mounts the aforesaid recording head cartridge H1000 represented in FIG. 1A and FIG. 1B. For the ink jet recording apparatus shown in FIG. 16, carriage scanning means, which is formed by the lead screw 204 and the guide shaft 205 arranged in parallel to each other, and the carriage motor (not shown), is provided for a housing. To the lead screw 204 and the guide shaft 205, a carriage 201 is installed movably in the direction parallel to the lead screw 204 and the guide shaft 205. The carriage 201 moves in parallel to the lead screw 204 when it rotates.

On the carriage 201, a recording head cartridge H1000, which is provided with the aforesaid ink jet recording head H1001 shown in FIG. 1A and FIG. 1B, is mounted, and a paper sheet pressure plate 209 is arranged in the vicinity of the surface of movement locus of the discharge surface of the ink jet recording head H1001.

Also, the ink jet recording apparatus is provided with the sheet feeding roller 207 that conveys the recording sheet 206 serving as a recording medium toward the recording area of the ink jet recording head H1001, and the sheet expelling roller 208 that expels the recording sheet 206 after recording by the ink jet recording head H1001. The sheet feeding roller 207 and the sheet expelling roller 208 are rotated by means of a motor (not shown). Such motor, the sheet feeding roller 207, the sheet expelling roller 208, and some others constitute recording medium carrying means which conveys the recording sheet 206 that receives liquid discharged from the ink jet recording head H1001 of the recording head cartridge H1000. Then, the carriage 201 reciprocates in the direction intersecting with the carrying direction of the recording sheet 206 by recording medium carrying means.

Ink discharged from the ink jet recording head H1001 adheres to the recording sheet 206 which faces the discharge port surface of the ink jet recording head H1001. Then, on the surface of the recording sheet 206, recorded images are formed. Interlocked with recording on the recording sheet 206 by the ink jet recording head H1001, the recording sheet 206 is being expelled to the outside by means of the sheet feeding roller 207 and the sheet expelling roller 208, which are rotated by use of a motor, and the sheet pressure plate 209.

What is claimed is:

1. An ink jet recording head comprising:

a base plate;

a plurality of pairs of heat generating resistive elements arranged correspondingly on one base plate, for use in discharging ink by generating thermal energy for discharging ink as ink droplets;

a plurality of ink discharge ports each arranged in a position facing a respective one of said heat generating resistive elements;

a plurality of ink flow paths each communicating with a respective one of said ink discharge ports;

elongated ink supply ports arranged on said base plate along the lines of said heat generating elements for use in discharging ink, and each communicating with a respective one of said plurality of ink flow paths; and a plurality of electrode portions arranged on said base plate along a plurality of the said supply ports so as to electrically connect said base plate and an exterior of said base plate, wherein are arranged on said base plate at least one temperature detector, arranged to detect the temperature of said base plate, and at least one means for heating said base plate, and wherein said means for heating said base plate is arranged at an area of said base plate on a side of said plurality of electrode portions from a longitudinal end of said plurality of ink supply ports.

2. An ink jet recording head according to claim 1, wherein a plurality of said means for heating said base plate are arranged on said base plate.

3. An ink jet recording head according to claim 2, wherein a plurality of said ink supply ports are arranged in parallel, and said means for heating base plate are arranged on said base plate in the vicinity of both end portions of said ink supply ports in the longitudinal direction symmetrically with respect to the ink supply port positioned in the center of said plurality of ink supply ports.

4. An ink jet recording head according to claim 3, wherein said means for heating said base plate are arranged on a line of symmetry of said base plate.

5. An ink jet recording head according to claim 1, wherein a plurality of said temperature detectors are provided on said base plate, and are arranged in the vicinity of end portions in the logitudinal direction on one side of said base plate.

6. An ink jet recording head according to claim 1, wherein a plurality of said ink supply ports are arranged in parallel, and said means for heating base plate is arranged on one location in the vicinity of the end portion of said ink supply ports positioned in the center of said plurality of ink supply ports on one side in the longitudinal direction.

7. An ink jet recording head according to claim 6, wherein said temperature detector is arranged in the vicinity of the end portion of said ink supply ports positioned in the center of said plurality of ink supply ports on the side opposite to the end portion on the arrangement side of said means for heating said base plate.

8. An ink jet recording head according to claim 1, wherein on one base plate, at least plural lines of heat generating resistive elements corresponding to discharge ports for use of plural colors, driving circuits for driving each line of heat generating resistive elements for use of ink discharges, and electrode portions for connecting said driving circuits with the outside are arranged, and each of elongated through openings serving as ink supply ports for use of each color ink is arranged on the area excluding at least each area of said base plate having said heat generating resistive elements for use of ink discharges, driving circuits, and electrode portions arranged, respectively.

9. An ink jet recording head according to claim 1, wherein said ink jet recording head uses energy generated by said heat generating resistive elements for use of ink discharges for creating film boiling in ink to discharge ink droplets.

10. An ink jet recording head, comprising:

a base plate;

a plurality of pairs of heat generating resistive elements arranged correspondingly on one base plate for use in discharging ink, by generating thermal energy for discharging ink as ink droplets;

a plurality of ink discharge ports each arranged in a position facing a respective one of said heat generating resistive elements;

a plurality of ink flow paths each communicating with a respective one of said ink discharge ports; and elongated ink supply ports arranged on said base plate along the lines of said heat generating elements for use in discharging ink, and each communicating with a respective one of said plurality of ink flow paths, wherein are arranged on said base plate at least one temperature detector arranged to detect the temperature of said base plate, and a plurality of means for heating said base plate, wherein said means for heating said base plate is arranged on said base plate in the vicinity an end portion of said ink supply ports, and wherein the number of said means for heating said base plate is smaller than that of said ink supply ports.

11. An ink jet recording apparatus comprising:

an ink jet recording head, having:

a base plate;

a plurality of pairs of heat generating resistive elements for use in discharging ink arranged on said base plate by generating thermal energy for discharging the ink as ink droplets, a plurality of ink discharge ports each arranged in a position facing a respective one of said heat generating resistive elements, a plurality of ink flow paths each communicating with a respective one of said ink discharge ports, elongated ink supply ports arranged on said base plate along the lines of said heat generating elements for use in discharging ink, and each communicating with said plurality of ink flow paths, and a plurality of electrode portions arranged on said base plate along a plurality of the ink supply ports so as to electrically connect said base plate and an exterior of said base plate, a plurality of said pairs being arranged in the direction substantially perpendicular to the direction of arrangement of said heat generating resistive elements arranged correspondingly on one base plate, and on said base plate, there being provided at least one temperature detector, arranged to detect the temperature of said base plate, and means for heating said base plate, and said means for heating said base plate being arranged at an area of said base plate on a side of said plurality of electrode portions from a longitudinal end of said plurality of ink supply ports;

a carriage for mounting said ink jet recording head thereon; and carriage scanning means for scanning said carriage in the direction substantially parallel to the arrangement direction of said plural pairs.

* * * * *

UNITED STATES PATENT AND TRADEMARK OFFICE

CERTIFICATE OF CORRECTION

PATENT NO. : 6,527,367 B2
DATED : March 4, 2003
INVENTOR(S) : Kenji Yabe

It is certified that error appears in the above-identified patent and that said Letters Patent is hereby corrected as shown below:

Column 6,
Line 3, "B." should read -- 1B. --.

Column 8,
Line 23, "side" should read -- sides --; and
Line 62, "plat" should read -- plate --.

Column 9,
Line 20, "after" should read -- after being --; and
Line 67, "element" should read -- elements --.

Column 12,
Line 42, "baseplate" should read -- base plate --.

Column 13,
Line 16, "form" should read -- from --; and
Line 66, "8 1" should read -- 8 pl --.

Column 15,
Line 45, "reduced the numbers" should read -- reduce the number --.

Column 16,
Lines 24 and 67, "of" should read -- with --.

Column 17,
Line 44, "one" should read -- in one --;
Line 63, "of" should read -- with --; and
Line 65, "Embodiment" should read -- Embodiments --.

UNITED STATES PATENT AND TRADEMARK OFFICE

CERTIFICATE OF CORRECTION

PATENT NO. : 6,527,367 B2
DATED : March 4, 2003
INVENTOR(S) : Kenji Yabe

It is certified that error appears in the above-identified patent and that said Letters Patent is hereby corrected as shown below:

Column 20,
Line 14, "vicinity" should read -- vicinity of --.

Signed and Sealed this

Twenty-third Day of September, 2003

JAMES E. ROGAN
*Director of the United States Patent and Trademark Office*